US008394256B2

(12) United States Patent
Gleeson et al.

(10) Patent No.: US 8,394,256 B2
(45) Date of Patent: Mar. 12, 2013

(54) METHOD FOR HAZE MITIGATION AND FILTERABILITY IMPROVEMENT FOR BASE STOCKS

(75) Inventors: James W. Gleeson, Burke, VA (US); Eric B. Sirota, Flemington, NJ (US); Charles L. Baker, Thornton, PA (US); Dennis A. Gaal, Glassboro, NJ (US); David Mentzer, Orlean, VA (US); John E. Gallagher, Jr., Lebanon, NJ (US); Min Chang, McLean, VA (US); Norman G. Cathcart, Cortland, NY (US); Stephen A. Geibel, Cortland, NY (US); Mark F. Hurwitz, Ithaca, NY (US); Tore H. Lindstrom, Tully, NY (US); Michael B. Whitlock, Cortland, NY (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 608 days.

(21) Appl. No.: 12/587,709

(22) Filed: Oct. 13, 2009

(65) Prior Publication Data

US 2011/0083995 A1 Apr. 14, 2011

(51) Int. Cl.
*C10G 73/32* (2006.01)

(52) U.S. Cl. ..... 208/38; 208/28; 208/29; 210/767; 210/791; 210/797; 210/798; 210/799

(58) Field of Classification Search ..... 208/28–29, 208/38; 210/348, 500.23, 500.25, 500.26, 210/500.35, 500.37–500.39, 500.41, 503–505, 210/767, 791, 797, 798, 799
See application file for complete search history.

(56) References Cited

U.S. PATENT DOCUMENTS

| | | | |
|---|---|---|---|
| 2,612,466 | A | 9/1952 | Kiersted et al. |
| 2,754,250 | A | 7/1956 | Shipman, Jr. |
| 4,169,039 | A | 9/1979 | Bushnell |
| 4,422,924 | A | 12/1983 | Onodera et al. |
| 4,820,400 | A | 4/1989 | Ryan et al. |
| 4,874,523 | A | 10/1989 | LaFreniere |
| 4,904,367 | A | 2/1990 | Ryan et al. |
| 5,529,844 | A | 6/1996 | Degen et al. |
| 5,628,916 | A | 5/1997 | Stevens et al. |
| 5,702,616 | A | 12/1997 | Degen et al. |
| 6,080,301 | A | 6/2000 | Berlowitz et al. |

(Continued)

FOREIGN PATENT DOCUMENTS

| | | | |
|---|---|---|---|
| DE | 243938 | A1 | 3/1987 |
| DE | 295655 | A5 | 11/1991 |

(Continued)

OTHER PUBLICATIONS

Vogel, E. et al. (1998). J. Phys. Chem. Ref. Data, 27(5), 947-970.*

(Continued)

*Primary Examiner* — Brian McCaig
(74) *Attorney, Agent, or Firm* — Liza Montalvo; David Weisberg

(57) ABSTRACT

The present invention is a process for removing waxy haze from and improving the filterability of base stocks including heavy mineral oil base stocks, gas-to-liquids (GTL) and hydrodewaxed or hydroisomerized waxy feed basestocks by filtering the waxy haze causing particles out of the base stock employing a filter characterized by a high surface area of pores accessible to the haze wax particles which have particles dimensions of no more than about 5 microns.

33 Claims, 4 Drawing Sheets

U.S. PATENT DOCUMENTS

| | | | | |
|---|---|---|---|---|
| 6,468,417 | B1 | 10/2002 | Biscardi et al. | |
| 6,468,418 | B1 | 10/2002 | Biscardi et al. | |
| 6,495,495 | B1 | 12/2002 | Alger et al. | |
| 6,579,441 | B1 | 6/2003 | Biscardi et al. | |
| 6,699,385 | B2 | 3/2004 | Miller | |
| 6,962,651 | B2 | 11/2005 | Miller et al. | |
| 6,979,700 | B2 * | 12/2005 | Ma | 521/64 |
| 2003/0207775 | A1 | 11/2003 | Sullivan et al. | |
| 2005/0261147 | A1 | 11/2005 | Rosenbaum et al. | |
| 2006/0019841 | A1 | 1/2006 | Clague | |
| 2006/0096932 | A1 * | 5/2006 | Dema et al. | 210/767 |
| 2009/0112041 | A1 | 4/2009 | Germaine et al. | |
| 2011/0083994 | A1 | 4/2011 | Sirota et al. | |

FOREIGN PATENT DOCUMENTS

| | | | |
|---|---|---|---|
| EP | 0385005 | A1 | 9/1990 |
| EP | 0356081 | B1 | 3/1993 |
| GB | 1073834 | | 6/1967 |
| GB | 2010900 | A | 7/1979 |
| GB | 2256199 | A | 2/1992 |
| JP | 72030401 | B | 7/1970 |
| WO | 8200029 | | 1/1982 |
| WO | 9712013 | | 4/1997 |
| WO | 2004033607 | A1 | 4/2004 |
| WO | 2005063940 | A1 | 7/2005 |
| WO | 2006040328 | A1 | 4/2006 |

OTHER PUBLICATIONS

R.R. Hemrajani, et al., Handbook of Industrial Mixing—Science and Practice, p. 370, Edited by E.L. Paul, et al., 2004, Wiley & Sons.

McCabe, et al., Unit Operations of Chemical Engineering, 5th Edition, p. 821, 1993

* cited by examiner

METHOD FOR HAZE MITIGATION AND FILTERABILITY IMPROVEMENT FOR BASE STOCKS

BACKGROUND OF THE INVENTION

1. Field of the Invention

The present invention relates to base stocks including heavy mineral oil base stocks, Gas-to-Liquids (GTL), hydrodewaxed, and hydroisomerized waxy feed base stocks and to such stocks of reduced/mitigated haze formation.

2. Related Art

Feed stocks for lubricating oil base stocks are generally mixtures of various carbon number hydrocarbons including by way of example and not limitation various carbon chain length paraffins, iso-paraffins, naphthenes, aromatics, etc. The presence of long carbon chain length paraffins in the hydrocarbon base stock causes pour point and cloud point to be relatively high, that is, the onset of solid wax formation in the oil occurs at relatively high temperature.

For lubricating oils to effectively function in their intended environments (internal combustion engines, turbines, hydraulic lines, etc.) they must remain liquid at low temperatures.

To this end hydrocarbon feed stocks used for lubricating oil base stock production are subjected to wax removal processes including solvent dewaxing wherein the wax is physically removed from the oil as a solid at low temperature using a solvent, or catalytic dewaxing using a catalyst that converts long chain normal or slightly branched long chain hydrocarbon (wax) by cracking/fragmentation into shorter chain hydrocarbon, to thereby reduce pour point and cloud point (both of which are measured at low temperature).

Waxy hydrocarbon feeds, including those synthesized from gaseous components such as CO and $H_2$, especially Fischer-Tropsch waxes are also suitable for conversion/treatment into lubricating base oils by subjecting such waxy feeds to hydrodewaxing or hydroisomerization/cat (and/or solvent) dewaxing whereby the long chain normal-paraffins and slightly branched paraffins are rearranged/isomerized into more heavily branched iso-paraffins of increased viscosity index and reduced pour and cloud point. Lubricating oils produced by the conversion/treatment of waxes produced from gaseous components are known as Gas-to-Liquids (GTL) base oils/base stocks.

Despite being of reduced low temperature pour point and cloud point, however, heavy base stocks including heavy mineral oil base stocks and heavy GTL base stocks are also subject to low level haze formation which appears at temperatures usually higher than those traditionally used to measure pour point or cloud point. The onset of haze is seen on standing at ambient temperatures, e.g., room temperature, i.e. temperatures between about 15 to 30° C., more usually 20 to 25° C.

The haze precursors are wax types which are more difficult to remove than are the waxes typically associated with pour point and cloud point and do not necessarily respond to conventional wax removal techniques such as solvent or catalytic dewaxing or would do so only with severe loss in yield.

Dewaxing using diluent components such as MEK, MIBK, and mixtures with toluene at low temperatures followed by filtration using cloth media are well known in the literature (see, for example, DILCHILL™ Exxon Mobil Corporation). These methods do not remove the small amounts of haze or haze precursors because the waxy particles are too small to be trapped on the filter cloth media used in such solvent dewaxing processes. In addition, those methods use considerable energy and are prohibitive to use for dehazing when not already in place for dewaxing. Also, imperfections in the filter cloth due to manufacturing flaws or wear in service can allow enough wax to leak through to cause haze to develop immediately or upon standing.

Methods based on adsorption of wax haze particles on fixed beds of pellets or powders have been described. They suffer from the inability to achieve acceptable combinations of adsorptive capacity, pressure drop across the adsorbent bed, and yield loss during the slow regeneration process required by such devices.

As previously indicated, haze can form in oils merely upon standing at room temperature even after the oil has been dewaxed to a low pour point such as −5° C. or even lower. Haze disappears on heating but can reappear on standing and even at room temperature. The waxes associated with haze are predominantly paraffinic in nature and include iso-paraffins and n-paraffins which are higher molecular in weight than are the waxes usually associated with pour point and cloud point.

Haze formation reduces the desirability of the oil for lubricating oil formulations from a visual perspective of quality.

A particularly challenging situation occurs when the haze does not form within about two days after manufacture, during which certification tests are made, but rather later after the lubricant base stock has been shipped to a lubricant blender or even after the lubricant product has been shipped to a lubricant user.

From a customer perspective, the appearance of haze has negative implications with regard to quality, customers usually associating high quality with oils exhibiting a clear and bright appearance on visual observation. The clear and bright standard is in accordance with ASTM D-4176-93 (Reapproved 1997). Haze can also be quantified under a turbidity test criterion expressed as nephelometric turbidity units (NTU) having a maximum value of 24. NTU is measured by a turbidimeter such as a Hach Model 18900 ratio turbidimeter, a Hach Model 2100P turbidimeter, etc. employed under the conditions specified by the manufacturer.

Other methods for determining turbidity include: ASTM D6181, Standard Test Method for Measurement of Turbidity in Mineral Insulating Oil of Petroleum Origni; ASTM D5180, Standard Test Method for Turbidity in Clear Liquids; ASTM D1889, Standard Test Method for Turbidity in Water.

Haze is also seen as posing a potential for problems during use insofar as the wax associated with the haze have the potential to clog the pores of the fine filters employed, for example, when using industrial circulating oils.

To address haze formation in hydroisomerized synthetic wax heavy lube oil having a kinematic viscosity @ 100° C. of about 10 $mm^2/s$ or greater mitigation steps such as higher reactor severity to create more isomerized product help lower the extent or intensity of haze but are generally, by themselves, insufficient, and also result in a reduced yield of the desired product. Restricting the distillation range to lower boiling molecular weights is also effective in reducing the haze potential of the oil but much of the 1000° F.+ range lube base stock will be sacrificed in that case.

Haze has been addressed in the recent art.

U.S. Pat. No. 6,579,441 reduces haze in lubricating oil base oil feeds by contacting the oil with a solid adsorbent to remove at least a portion of the haze precursors. The solid adsorbents reduce the cloud point and haze of the oil with minimal effect on yield. Sorbents used in the process are generally solid particulate matter having high sorptive capacity and with a surface having some acidic character. Acid character is determined by measurement of acid site density, determined using, e.g., infra-red spectroscopic measurement of adsorbed basic molecules such as ammonia, n-butyl amine or pyridine. Sorbent materials include crystalline molecular sieves, alumino-silicate zeolites, activated carbon, aluminas, silica-alumina, and clays (e.g., bauxite, Fullers Earth, attapulgite, montmorillonite, halloysite, sepiolite) in various forms, e.g., powder, particles, extrudates, etc.

The oil to be treated is contacted with the adsorbent in batch mode or under continuous conditions using a fixed bed, moving bed, slurry bed, simulated moving bed, magnetically stabilized fluidized bed employing upflow, downflow or radical flow oil circulation, at temperatures usually below 66° C. and more preferably between about 10° C. and 50° C.

See also U.S. Pat. No. 6,468,417 and U.S. Pat. No. 6,468,418.

WO 2004/033607 teaches heavy hydrocarbon compositions useful as heavy lubricant base stocks. The heavy hydrocarbon composition comprise at least 95 wt % paraffin molecules of which at least 90 wt % are iso-paraffins, having a KV by ASTM D-445 of above 8 $mm^2/s$ at 100° C., an initial boiling point of at least 454° C. and an end boiling point of at least 538° C. This heavy hydrocarbon composition of this application is a particular GTL heavy oil made from Fischer-Tropsch wax subjected to hydroisomerization. This heavy stock will typically be mildly hydrofinished and/or dehazed after hydrodewaxing to improve color, appearance and stability. It is stated that dehazing is typically achieved by either catalytic or absorptive methods to remove those constituents that result in haziness but no details are provided.

U.S. Pat. No. 6,699,385 teaches a process for producing a low haze heavy base oil including the steps of providing a heavy waxy feed stream having an initial boiling point greater than 900° F. and having a paraffin content of at least 80%, separating the heavy feed stream into a heavy fraction and a light fraction by deep cut distillation, and hydroisomerizing the light fraction to produce a low haze heavy base oil. In this patent "low haze" means a cloud point of 10° C. or less, preferably 5° C. or less, more preferably 0° C. or less. It does not appear to mean haze which forms on standing at room temperature.

WO 2005/063940 teaches a process for preparing a haze-free base oil having a cloud point of below 0° C. and a kinematic viscosity at 100° C. of greater than 10 $mm^2/s$ by hydroisomerization of a Fischer-Tropsch synthesis product, isolation of one or more fuel products and a distillation residue, reduction of the wax content of the residue by contacting the residue with a hydroisomerization catalyst under hydroisomerization conditions and solvent dewaxing the hydroisomerized residue to obtain a haze-free base oil. See also WO 2005/063941.

U.S. Pat. No. 6,962,651 teaches a method for producing a lubricant base oil comprising the steps of hydroisomerizing a feedstock over a medium pore size molecular sieve catalyst under hydroisomerization conditions to produce an isomerized product have a pour point of greater than a target pour point of the lubricant base oils, separating the isomerized product into at least a light lubricant base oil having a pour point less than or equal to the target pour point of the lubricant base oil and into a heavy fraction having a pour point of equal to or greater than the target pour point of the lubricant base oils and a cloud point greater than the target cloud point of the lubricant base oils and, dehazing the heavy fraction to proved a heavy lubricant base oil having a pour point less than or equal to the target pour point of the lubricant base oils and a cloud point less than or equal to the target cloud point of the lubricant base oils. The feedstock can be Fischer-Tropsch wax. Dehazing is described as a relatively mild process and can include solvent dewaxing, sorbent treatment such as clay treating, extraction, catalytic dehazing and the like.

U.S. Pat. No. 6,080,301 teaches a premium synthetic lubricating oil base stock having a high VI and a low pour point made by hydroisomerizing a Fischer-Tropsch synthesized waxy paraffinic feed wax and then dewaxing the hydroisomerate to form a 650-750° F.+ dewaxate. Fully formulated lube oils can be made from appropriate viscosity fractions of such base stock by addition of suitable additives which include one or more of a detergent, a dispersant, an antioxidant, an antiwear additive, a pour point depressant, a VI improver, a friction modifier, a demulsifier, an anti-foamant, a corrosion inhibitor and a seal swell control additive.

US Published Application 2005/0261147 teaches lubricant blends with low Brookfield viscosities, the base oil being a mixture of a base oil derived from highly paraffinic wax and a petroleum derived base oil and containing a pour point depressant. Representative of base oils derived from highly paraffinic wax are base oils derived from Fischer-Tropsch wax via hydroisomerization. Pour point depressants are described as materials known in the art and include, but are not limited to esters of maleic anhydride-styrene copolymers, polymethacrylates, polyacrylates, polyacrylamides, condensation products of haloparaffin waxes and aromatic compounds, vinyl carboxylate polymers, terpolymers of dialkyl fumarates, vinyl esters of fatty acids, ethylene-vinyl acetate copolymers, alkyl phenol formaldehyde condensation resins, alkyl vinyl ethers, olefin copolymers and mixtures thereof. The preferred pour point depressant is identified as polymethacrylate.

U.S. Pat. No. 6,495,495 teaches an additive comprising a blend of an alkyl ester copolymer, preferably an ethylene-vinyl acetate copolymer, and a naphthenic oil to improve flow properties of a mineral oil and to prevent filter blockage of a filter due to wax formation.

US 2006/0019841 teaches the use of a $C_{12}$-$C_{20}$ polyalkyl methacrylate polymer as a lubricating oil additive for mineral oil to improve the filterability of the lube oil as compared to the mineral oil base oil.

US 2003/0207775 teaches lubricating fluids of enhanced energy efficiency and durability comprising a high viscosity fluid blended with a lower viscosity fluid wherein the final blend has a viscosity index greater than or equal to 175. Preferably the high viscosity fluid comprises a polyalphaolefin and the lower viscosity fluid comprises a synthetic hydrocarbon or PAO and may further comprise the addition of one or more of an ester, mineral oil and/or hydroprocessed mineral oil. Additives can also be present and include one or more of dispersants, detergents, friction modifiers, traction improving additives, demulsifiers, defoamants, chromophores (dyes) and/or haze inhibitors.

The high viscosity fluid has a kinematic viscosity greater than or equal to 40 $mm^2/s$ @ 100° C. and less than or equal to 3,000 $mm^2/s$ @ 100° C. while the lower viscosity fluid has a kinematic viscosity of less than or equal to 40 $mm^2/s$ at 100° C. and greater than or equal to 1.5 $mm^2/s$ at 100° C. Haze inhibitors are not identified or described in any way.

It would be a significant technical advance if the haze issue associated with heavy GTL and hydrodewaxed or hydroisomerized waxy feed lube base stocks could be solved by a technique other than subjecting the base stock to an additional or more severe final processing step, such as more severe solvent or catalytic dewaxing or adsorption, or more severe hydrodewaxing or hydroisomerization all of which are marked by a reduction in yield.

DESCRIPTION OF THE INVENTION

Figure 1B:
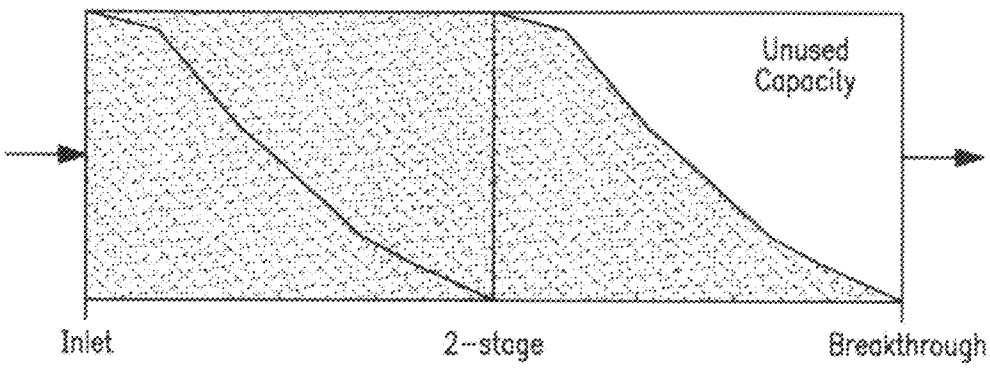
FIG. 1 is a presentation of the increase in capacity resulting from the use of a two-stage filter unit as compared to a one-stage filter unit.

The present invention relates to a process for the reduction/mitigation of waxy haze formation in base stocks susceptible to haze formation including heavy mineral oil base stock and Gas-to-Liquid (GTL) stocks, preferably Gas-to-Liquids (GTL), hydrodewaxed, and hydroisomerized (and optionally solvent and/or catalytically dewaxed) waxy feed lubricating oil base stocks by filtering the haze producing wax out of the base stock using a filter characterized by a high surface area of at least 0.5 $m^2/g$ to up to 100 $m^2/g$ and pores of from 0.2 to 50 microns accessible to the haze causing wax particles which have haze wax particle dimensions of no more than about 5 microns, usually no more than 3 microns, more typically about 0.2 microns. Preferably the process reduces the haze in hazy base stocks to the point where the base stock is clear and bright at a target haze disappearance temperature which can be either at ambient temperature, or some other selected haze disappearance/dissolution temperature (HDT), preferably an HDT of 20° C. and remains clear and bright/haze free for at least 14 days, preferably at least 30 days, more preferably at least 90 days, still more preferably for up to 6 months or longer.

The process involves the following general steps, not all of which are needed in all instances for all waxy hazy lubricating oil stocks:

1. optionally remove non-waxy particulate matter from the lubricating oil stock by filtration, adsorption, centrifugation, membrane separation, distillation or some other standard liquid/solid separation technique;
2. optionally add a diluent to the lubricating oil stock;
3. hold the (optionally diluted) lubricating oil stock at ambient conditions or preferably with slight cooling for a time sufficient for visible haze to form (i.e., incubation period);
4. filter the waxy haze causing wax from the incubated, and preferably cooled hazy lubricating oil stock using a filter characterized by a high surface area in pores accessible to the haze causing wax particles;
5. recover the dehazed oil as filtrate;
6. remove the diluent from the filtrate if an optional diluent was used;
7. optionally and preferably regenerate the wax saturated filter.

In practice, optional steps 1 and 2 may be reversed.

By dehazing the lube oil, the haze disappeared temperature is reduced from above ambient temperature or ambient temperature to ambient or below ambient temperature, i.e., following dehazing haze will not appear on standing at the temperature which the undehazed oil exhibited haze but rather on standing only after cooling below some haze disappearance temperature selected by the practitioners which can be either above or below the ambient temperature.

Haze forming waxy molecules addressed in the present invention are those observed in lubricating oil stocks including heavy mineral oil base stocks and base oils, GTL base stock(s) and base oil(s), or hydrodewaxed, or hydroisomerized (and optionally solvent and/or catalytically dewaxed) waxy feed lubricating oil base stock(s) and base oil(s) the haze becoming visible on standing at temperatures above the traditionally measured cloud point of the oil. Lubricating oil stocks exhibiting haze and treated by the process of the present invention are those having a kinematic viscosity at 100° C. of at least 4 $mm^2/s$, preferably at least 6 $mm^2/s$, more preferably at least 8 $mm^2/s$, still more preferably at least 10 $mm^2/s$. Typical cloud points of such stocks are 5 to −5° C.

The haze addressed in the present invention is that which appears at or near room temperature, the haze being indicative of the flocculation of waxy molecules in the oil which can also interfere with the ability of the base stock(s) or base oil(s) to quickly filter through small openings such as the filters employed in equipment utilizing for example hydraulic fluids.

The haze of interest is usually not immediately apparent but appears over time while the oil stands at ambient temperature. It is speculated that the waxy molecules associated with this haze are present in very low concentrations, approximately 10 to 200 ppm whereas the concentration of waxy molecules associated with the traditionally measured cloud point is believed to be about 1000 ppm or higher, while the amount of waxy material associated with pour point of the oil is about 1 wt % (about 10,000 ppm).

Further, not only is the amount of waxy material associated with haze substantially lower than the amounts associated with cloud point and pour point but the nature of the waxy material itself is believed to be different.

Pour point and cloud point are traditionally associated with waxy material primarily consisting of n-paraffins or slightly branched iso-paraffins. The haze addressed in the present invention, however, is believed to be substantially branched iso-paraffins. The normal and sparcely branched paraffins removed by the dewaxing step to reduce pour point and cloud point cover the full boiling point range of the sample but have longer unbranched chain segments than molecules in the haze or dehazed oil. Normal paraffins can crystallize into full three dimensional structures, and therefore are not inhibited in growing to larger sizes that are more easily removed by filter cloths employed in solvent dewaxing. The amount of haze forming wax, therefore, is much less than that of the pour and cloud forming wax that is removed by dewaxing, as well as being of different morphology, thus the haze particles are much smaller, too small to be removed by filter cloths of solvent dewaxing as well as present in very low concentrations. Even the presence of very little of such wax, such as an amount which could easily pass through a filter cloth designed for pour and cloud point reduction of waxy oil or escape catalytic conversion under standard catalytic dewaxing or hydrodewaxing conditions, is sufficient to cause haze formation in lubricating oils upon standing at ambient temperature over time.

In the present invention the effective mitigation of haze is evidenced by the treated oil exhibiting a clear and bright appearance at a haze disappearance temperature, e.g. ambient temperature or some other haze disappearance temperature selected by the practitioner, for at least 14 days, preferably 21 days or higher, more preferably 30 days or higher, still more preferably 60 days or higher, or by exhibiting an NTU value of less than 2, preferably about 1.5 or lower, more preferably about 1.0 or lower for at least 14 days. More preferably, the treated oil exhibits a clear and bright appearance at a haze disappearance temperature of 20° C. or less, preferably 15° C. or less, for at least 14 days, preferably at least 6 months.

Clear and bright refers to a visual rating wherein the trained observer is able to see "haze or floc" formation in the oil. A rating of "hazy" would indicate lack of clarity due to particles evenly dispersed throughout the sample; often the particles are too small to detect as discrete, distinct objects. "Floc" would be due to much larger particles unevenly dispersed in the oil sample, frequently settling or concentrating in one section of the sample, such as at the bottom of the sample. The determination of whether a sample is clear and bright is a subjective judgment made by a trained observer of a sample under particular conditions. In the present instance, the conditions employed involved partially filling a 4 oz. Tall form bottle having a light path through the bottle of 1 to 1.5 inches and observing the sample under typical laboratory conditions with light approaching the back of the sample at about 10 to 20° off axis from the viewer. The light source is generally standard laboratory illumination which is typically fluorescent light. For long-term clear and bright stability the sample is stored in darkness at ambient temperatures. For most measurements "ambient temperature" was kept consistent by use of an incubator set at 68° F. (20° C.). The samples are stored and observed without agitation.

A measure of haze in heavy base oils such as heavy mineral oil base oils or GTL base stock(s) and/or base oil(s) and hydrodewaxed and hydroisomerized waxy feed lubricating oil base stock(s) and/or base oil(s) can be ascertained by use of a turbidity test using any typical turbidity meter known in the industry such as Hach Co. Model 2100P Turbidimeter or Hach Model 18900 ratio turbidimeter. A turbidity meter is a nephelometer that consists of a light source that illuminates the oil sample and a photoelectric cell that measures the intensity of light scattered at a 90° angle by the particles in the sample. A transmitted light detector also receives light that passes through the sample. The signal output (units in nephilometric turbidity units or NTUs) of the turbidimeter is a ratio of the readouts of two detectors. Meters can measure turbidity over a wide range from 0 to 10,000 NTUs. The instrument must meet US-EPA design criteria as specified in US-EPA method 180.1. NTU values measured for a number of representative oil samples at 25° C. correlated to the onset of haze are presented below.

| NTU value | Appearance |
|---|---|
| 20 | Cloudy |
| 2-5 | Visibly hazy |
| 0.0 to <2 | little haze/clear & bright |

Haze disappearance temperature is a superior measure of the clarity and resistance of the oil haze formation as compared to NTU and even clear and bright. The Haze Disappearance Temperature (HDT) can be measured by the method and apparatus described in copending application JJD-0621.

The method comprises placing a sample of the base stock in a cuvette which has optical windows on opposite sides. Cuvettes are currently available with spacings between the windows of standard path lengths of 0.5 mm, 1 mm, 2 mm, 5 mm and 10 mm. It is preferred to use a cuvette with a path length of 10 mm. The sample placed in the cuvette is at a temperature sufficiently high to prevent any nucleation of haze-forming constituents. Thus, the sample at the time of placement in the cuvette should be at an elevated temperature of about 80° C. to 120° C. If the sample is at a lower temperature when placed in the cuvette, the cuvette and the sample are heated to a temperature sufficient, e.g., about 90° C., to ensure dissolution of any haze wax. The cuvette is irradiated with light and the light transmission through the sample is measured. The sample in the cell is cooled to below ambient temperature or to below a target temperature. During the cooling the amount of light transmitted through the sample is measured. When haze particles form in the sample, they increase the amount of light scattered by the sample and decrease the amount of light transmitted through the sample compared to when haze particles are completely dissolved. Cooling is conducted at a constant rate generally in the range of about 0.1 to 1° C. per minute, preferably about 0.5° C. per minute. The temperature at which the transmitted/measured signal strength falls below that of the haze-free sample is the haze disappearance temperature, or HDT, of that oil sample. The "target" HDT of the dehazed oil is usually some temperature selected by the practitioner which is lower than the measured HDT of the oil sample prior to the practice of the dehazing process.

The base stock(s) and/or base oil(s) for which ambient temperature haze is mitigated by the present method are lubricating oil stocks including heavy mineral oil lubricating oil stocks, Gas-to-Liquid (GTL) base stock(s) and/or base oil(s) and hydrodewaxed or hydroisomerized waxy feed lubricating oil base stock(s) and/or base oil(s) which have cloud points (by ASTM D-5773) of about 5 to −5° C., a kinematic viscosity (by ASTM D-445) at 100° C. of at least 4 $mm^2/s$, preferably at least 6 $mm^2/s$, more preferably at least 8 $mm^2/s$, still more preferably at least 10 $mm^2/s$ and higher and a typical boiling range having a 5% point ($T_5$) above 900° F. and a $T_{99}$ point of at least 1150° F., preferably >1250° F. Light oils such as the 4 $mm^2/s$ oils, while not necessarily having inherent haze problems could develop haze problems if inadvertently contaminated with other stocks which do have haze problems or if the light stock is contaminated during standard dewaxing processes practiced to reduce pour point and cloud point wherein inadvertently haze wax along with regular pour point and cloud point wax is passed to the light stock despite the dewaxing process.

As previously stated, this dehazing process can be practiced on heavy lubricating oil stock, including heavy mineral oil lubricating oil stocks, non-conventional or unconventional base stock(s) and/or base oils(s) such as Gas-to-Liquids (GTL) base stock(s) and/or base oil(s) and hydrodewaxed or hydroisomerized/catalytically dewaxed (and/or solvent dewaxed) base stock(s) and/or base oil(s).

Non-conventional or unconventional base stocks and/or base oils include one or more of a mixture of base stock(s) and/or base oil(s) derived from one or more Gas-to-Liquids (GTL) materials, as well as hydrodewaxed, or hydroisomerized/cat (and/or solvent) dewaxed base stock(s) and/or base oils derived from natural wax or waxy feeds, mineral and or non-mineral oil waxy feed stocks such as gas oils, slack waxes (derived from the solvent dewaxing of natural oils, mineral oils or synthetic, e.g. Fischer-Tropsch feed stocks), natural waxes, and waxy stocks such as gas oils, waxy fuels hydrocracker bottoms, waxy raffinate, hydrocrackate, thermal crackates, foots oil or other mineral, mineral oil, or even non-petroleum oil derived waxy materials such as waxy materials received from coal liquefaction or shale oil, linear or branched hydrocarbyl compounds with carbon number of about 20 or greater, preferably about 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds and/or elements as feedstocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) and/or base oil(s) include oils boiling in the lube oil boiling range (1) separated/fractionated from synthesized GTL materials such as for example, by distillation and subsequently subjected to a final wax processing step which is either or both of the well-known catalytic dewaxing process, or solvent dewaxing process, to produce lube oils of reduced/low pour point; (2) synthesized wax isomerates, comprising, for example, hydrodewaxed, or hydroisomerized/followed by cat and/or solvent dewaxing dewaxed synthesized wax or waxy hydrocarbons; (3) hydrodewaxed, or hydroisomerized/followed by cat and/or solvent dewaxing dewaxed Fischer-Tropsch (F-T) material (i.e., hydrocarbons, waxy hydrocarbons, waxes and possible analogous oxygenates); preferably hydrodewaxed, or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed, or hydroisomerized/followed by cat and/or solvent dewaxing dewaxed wax or waxy feed preferably F-T material derived base stock(s) and/or base oil(s), are characterized typically as having kinematic viscosities at 100° C. of from about 2 $mm^2/s$ to about 50 $mm^2/s$, (ASTM D445). They are further characterized typically as having pour points of about −5° C. to about −40° C. or lower. (ASTM D97) They are also characterized typically as having viscosity indices of about 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a dumbbell blend wherein the blend exhibits a target kinematic viscosity.

In a preferred embodiment, the GTL material, from which the GTL base stock(s) and/or base oil(s) is/are derived is an F-T material (i.e., hydrocarbons, waxy hydrocarbons, wax).

In the present inventive process, the wax filter has a total material surface area of at least about 0.5 $m^2/g$ up to 100 $m^2/g$ accessible to the wax particles, and pores of from 0.2 to 50 microns, preferably 0.2 to 10 microns, more preferably 0.2 to 5 microns, still more preferably 0.2 to 1 micron, most preferably 0.2 to 0.5 micron. "Pores" means the spacings between strands of fibers of the materials making up the filter material, e.g. the spacings between the fibers of the matted filter material. Typical wax haze particles are from less than about 5 microns to about 0.2 microns in size. This size criteria for the media is what helps distinguish the present invention from typical state of the art adsorptive dehazing methods using adsorbents such as silica, alumina, fullers earth, activated carbon, bauxite and zeolite in which the surface area is present in pores of only about 0.001 micron and, therefore, are not accessible to waxy haze particles. The size of the haze particles also helps distinguish the present invention from typical solvent dewaxing using filter cloths, in which the wax particles are much larger, permitting much different media to be used. In the present invention, the filter media will have dual functionality, both adsorption functionality and barrier, or sieving, functionality. Barrier filtration provides long on-time filtration before regeneration is required. Besides equipment utilization, barrier functionality provides high product yield and minimizes demand for regeneration utilities and byproducts. In addition, barrier filtration tends to balance fluid flow through various portions of the media that may differ in permeability due to heterogeneities from manufacturing of the media, heterogeneities from forming pleats for efficient packing in a cartridge, or heterogeneities due to deformation during use. To work in this way, it is advantageous that the pores of the filter media be small enough to trap/capture the wax particles so that the pressure drop across the filter due to particle trapping exceeds the pressure drop of the media itself.

Media such as fiber metal, fiber glass, and aramid fiber all gave pressure drops due to plugging of at least about 2 psi, while the initial unplugged pressure drop was less than about 2 psi. Therefore, a medium with nominal pore size not more than about 10× larger than the nominal haze wax particle size is preferred.

The wax filter material employed should have a surface area of between at least 0.5 $m^2/g$, preferably at least 5 $m^2/g$, more preferably at least 10 $m^2/g$, still more preferably at least 15 $m^2/g$ to up to 100 $m^2/g$, preferably up to about 50 $m^2/g$, and have pores of from 0.2 to 50 microns, preferably from 0.2 to 10 microns, more preferably 0.2 to ≦1 micron. The pore size should not be so small that the pressure causes the formed filter cake to break or causes flow rate through the media to dislodge the particles by shearing forces. E.g., the filtrate from a filtration at >100 psi through 1.0 and 0.8 micron pore size sintered metal membranes, which possessed little surface area, was hazy (see Table 2). However, barrier filtration alone has the disadvantage that it is difficult to completely remove the solid haze, due to the distribution of both wax particle sizes and media pore sizes. This is especially important in dehazing because of the small particle size and the fact that even low leakage can cause the filtrate to remain hazy. Adsorptive functionality can remove the particles that are difficult to completely capture by the barrier mechanism.

The filtration/adsorption media can be of different physical forms. Sheets or mats of material can be employed. The sheets or mats are preferably sheets of random non-woven fiber typically less than 0.5 c.m. in thickness, i.e., felt. Woven sheets with small enough pores between threads would also be acceptable, provided the sheets exhibited sufficiently high total material surface area and pores between fiber strands of sufficiently small a size. The fiber material can also be in the form of a tube or cylinder of any internal diameter and any length, the length preferably being greater than the internal diameter of the tube or cylinder. When sheets or mats are used they can be used as individual sheets or stacks of sheets. Individual or multiple sheets can be wound into a cylinder or tube or can be spirally wound around a hollow central core, each sheet being separated from any other sheet or sheet layer by a fluid permeably spacer sheet thereby forming a fluid passage chamber between each sheet or sheet layer creating retentate and permeate spaces, as in the case of spiral wound membranes which are known in the art and operate under cross flow filtration conditions. In the case of tubes or cylinders of filter media or spiral wound membrane configured sheets the diluted waxy feed would be fed into the center of the tube or the core of the spiral wound element, the retentate would pass through the center of the tube while the permeate would pass into the permeate spaces and move perpendicular or crossflow to the flow of the feed/retentate through the center of the tube or cylinder or central core of a spiral wound element. This crossflow of permeate through the cylinder or tube or through the permeate space of the spiral wound element (crossflow referring to the direction of flow of the permeate with respect to the direction of flow of the feed/retentate through the cylinder or tube or the retentate space of the spiral wound element) permits operation of the process at a pressure drop of about 20 psi. Use of the spiral wound element would permit the employment of higher dilution concentrations than would flat fiber sheet filtration. Diluted feed viscosity of 3-4 $mm^2/s$ could be employed to result in a reduction in power dissipation and heating in the fluid due to pumping. This reduction in heating due to lower pumping pressures would have the advantage of avoiding the dissolution or melting of the haze particles in the feed which dissolved haze particles would otherwise pass through the filter and remain in the oil, thus resulting in a decrease in the efficiency of the dehazing process. Further, reducing the pumping forces employed further reduces the possibility that the wax haze particles are sheared and pass through the filter.

Many materials of the right pore size and surface area will work. Those of relatively high surface energy, e.g., fibrous glasses, fibrous metal, oxidized fibrous metal, and functionalized polymers (e.g., polyimides, fibrillated aramide, nylon) will resist scouring of previously adsorbed haze as the pressure drop and interstitial flow rate within the media increase. Therefore, media with high energy (e.g. materials with functional groups, e.g. one or more oxygen-containing groups, sulfur-containing groups, nitrogen-containing groups, aromatic groups) surfaces are preferred but not required over those with lower energy surfaces (materials without functional groups e.g., polyethylene, polypropylene, PTFE).

The dehazing process is described in greater detail below.

Removing Nonwaxy Particulates by Filtration or Distillation

Lube base stocks often have enough nonwaxy particulates to irreversibly plug the wax filter. To extend the life of the wax filter, it is recommended that nonwaxy particulates such as catalyst fines, dirt, entrained water, etc., be removed up-stream of the wax filter. The practice of such a pre-filtering step is left to the discretion of the practitioner. Any technique commonly used to remove particulate or suspended matter in oil can be employed. Possibilities include cross-flow filtration, backwash filtration, distillation, centrifugation, membrane separating, settling followed by decantation, etc.

Adding a Diluent

This is an optional step to reduce the pressure drop across and/or increase the flux through the wax filter due to viscosity reduction. A diluent can also accelerate wax formation due to viscosity reduction. Reduction in the solubility of the wax, such as caused by ketone addition in conventional solvent dewaxing, is not necessary. Diluents can include propane, jet, diesel, kerosene, gas oil, light fuel oil, gasoline etc, derived from mineral/petroleum oil sources or GTL or wax isomerization. Such diluents will be of lower viscosity, e.g., 0 to 4 $mm^2/s$, preferably 0 to 2 $mm^2/s$, @40° C., boiling at 400° F. or less (204° C. or less) and, if employed at all will be used in an amount of about 5 to 67 wt %, preferably about 5 to 35 wt %. It is preferred that light diluent be employed because heavy diluents will have a lesser influence on desirable viscosity reduction and be more difficult subsequently to strip from the dehazed oil. GTL diluents, preferably GTL naphtha will introduce fewer impurities into the process because of the inherent purity and be more easily removed from the final dehazed product. GTL naphtha was used successfully as a diluent and it partially dissolves the wax haze. It is lower in cost, more readily available in a GTL process, and is more compatible with filter construction materials. This ability to use diluents that dissolve haze rather than neutral solvents or antisolvents expand the choice of diluents to improve cost or accessibility or chemical compatibility of the diluent.

Formation Of Haze (Incubation)

For the process to work it is necessary that the base stock being filtered actually be hazy during the haze filtration step. The wax associated with ambient temperature haze is not effectively filtered from the base stock unless solid particle haze is present, preferably visible haze at filtration conditions.

Wax haze can take over a month to develop. To inventory (store) such base stock in tankage until its long term appearance is verified to be satisfactory or for haze to form is impractical. It has been found that haze formation can be accelerated by lowering the temperature. If the stock to be dehazed is not mixed with a diluent, then cooling the stock to a few degrees below the lowest target haze disappearance temperature, e.g. the anticipated ambient temperature or some other haze disappearance temperature (HDT) selected by the practitioner, at least 2° C. below, preferably about 5 to 20° C. below the lowest target haze disappearance temperature should be sufficient. More preferably the cooling can be to between 10° C. to 15° C. below the lowest HDT of the dehazed oil. If the stock to be dehazed is mixed with a diluent the diluted stock can be cooled to a few degrees below, preferably to at least about 10° C. below, more preferably at least about 20° C. below, still more preferably at least 25° C. below the lowest HDT target of the dehazed oil. In general, cooling to a temperature of about the cloud point of the oil to be dehazed is satisfactory.

The temperature of the chilling medium used during incubation is also important. The difference in temperature between the chilling medium and the stock to be dehazed should be no more than 50° C., preferably no more than 35° C., more preferably no more than 25° C. Chilling of the undiluted or diluted waxy feed during incubation can be accomplished by any of a number of techniques. Indirect chilling can be employed in which the chilling medium is a refrigerant which is passed through one or more heat exchange tube(s) situated in a vessel containing the diluted or undiluted waxy feed. Alternatively the diluted or undiluted waxy feed can be passed through one or more heat exchange tubes situated in a vessel containing the refrigerant. In another embodiment chilled diluent solvent can be used as the chilling medium and added directly to the waxy feed to lower the temperature of the total waxy feed/diluent mixture. In yet another embodiment chilled/refrigerated inert gas such as nitrogen can be sparged through either the undiluted waxy feed or diluted waxy feed. Such sparging reduces the need for heat exchange tubes, pumping, pump around of refrigerant and/or of waxy feed. Elimination of waxy feed pumping reduces the possibility of wax particle breakage through shearing of any formed haze wax particles permitting the formation of larger, more easily removed particles. Sparging also provides the gentle energy needed to mix waxy feed with diluent liquid also without employing pumping, impellers, static mixers or other mechanical mixing means. A draft tube can be added to the sparging vessel to further enhance mixing by increasing the liquid circulating rate due to convection. While mixing and circulation are desirable, high shear can be undesirable as performance during filtration can be degraded. What constitutes low shear or too high a shear, however, depends on numerous variables including, but not limited to, oil feed viscosity, apparatus geometry, degree of solvent/diluent addition, type of diluent, diluent temperature, cooling temperature, filter medium, pore size and surface area of filter medium, duration of mixing shearing. Determination of what constitutes an acceptable level of shear is left to the practitioner to establish taking into account all the possible variables in his particular situation. Dehazing processes using different equipment or using one or more of different oils, diluents, diluent amounts, diluent temperatures filter media, filter pore size, filter surface area, cooling rates, mixing durations, etc., while possibly undergoing or experiencing the same degree or level of shear can exhibit different filtration performances. In general, a shear of less than about 2000 $seq^{-1}$ is desirable, preferably less than 500 $seq^{-1}$, more preferably less than 300 $seq^{-1}$, still more preferably less than 100 $sec^{-1}$.

Cooling accelerates onset of solid haze particle formation, preferably the formation of visible haze. The duration of such cooling, i.e., the haze incubation period, therefore, depends on the cooling temperature selected, the volume of oil being cooled, the method of cooling and the amount of haze precursor present in the oil stock to be dehazed. Thus, the time is that which is sufficient for solid haze particle formation to occur. Such time can range from a few minutes to several hours, e.g., from 2 minutes to 3 hours, preferably about 5 minutes to 2 hours, more preferably about 10 minutes to 1 hour. Optionally the temperature can be lowered below the filtration temperature to accelerate haze formation then the temperature raised to the filtration temperature. For example, assuming a desired filtration temperature of 15° C., one would cool from ambient (about 20° C.) to about 0° C., hold for a period of time (incubation period) then raise the temperature to 15° C. and filter. The filtration temperature of 15° C. was selected in the above exemplification on the assumption that the desired target HDT of the dehazed oil is to be about 20° C.

As previously indicated, when a diluent is used that partially or completely dissolves the haze at ambient temperature, the temperature to which the mixture is lowered can be lowered further to compensate for the increase in wax solvency in response to the dilution in addition to the amount of temperature lowering needed to accelerate haze formation. For example, it was found that the rate of increase in light scattering in an undiluted sample at about 15° C. was about the same as in a sample diluted with 34% naphtha at 7° C. (i.e. about 8° C. lower).

Waxy Oil Filtration

Filtration of an undiluted feed is preferably carried out a few degrees e.g., 2-15° C. below the desired lowest target haze disappearance temperature (HDT) of the dehazed oil, usually below ambient temperature. Unexpectedly, it has been found that even with the best media, turbidity was seen in the filtered to oil when it was measured at the same temperature as was used in the filtration process, that is (e.g.) filtration at ambient temperature failed to reduce haze at ambient temperature, similarly filtration at the final desired target HDT did not reduce haze when haze was measured at that same temperature. However, when filtration was carried out a few degrees below ambient temperature or a few degrees below a preselected target HDT, turbidity breakthrough or haze appearance, as measured at ambient temperature or at the target HDT, occurred later during the filtration step than when filtration was carried out at the target HDT or at ambient temperature. For diluted feeds in which the diluent dissolves haze, the temperature at which haze disappears (HDT), the incubation temperature, and the filtration temperature are all lower than with undiluted feed, as previously indicated.

It is only necessary to lower the temperature enough that any components that could form haze (at ambient temperature or at target HDT) would crystallize at a rapid rate. Typically, this temperature is about 5 to 20° C. below the lowest anticipated ambient temperature or the target haze disappearance temperature (HDT).

The flux, or amount of materials passing through the filter medium in a given time per unit of filter medium area must be kept sufficiently low to effectively remove haze. Thus, the hazy oil must pass at a slow enough rate through the filter media so as to afford the haze wax an opportunity to become trapped in the pores of the filter media.

For filter media the flux can be expressed in terms of liters of hazy oil/sec-sq meter of the filter media. Flux in the range of 0.007 to 0.7 liter/($s \cdot m^2$), preferably 0.014 to 0.34 liter/($s \cdot m^2$), more preferably 0.020 to 0.20 liter/($s \cdot m^2$) of face surface area of the filter material can be employed, the actual flux employed depending on numerous variables including the viscosity of the oil being filtered, whether the oil is diluted or undiluted, the amount of haze wax in the oil, the filtration temperature, the dehazed oil target temperature (e.g., ambient or some different higher or lower selected haze disappearance temperature).

Diluent Removal

If a diluent was added to the haze oil, the diluent is removed from the now dehazed oil using any appropriate separation technique, e.g., stripping, distillation, membrane separation, etc.

Filter Regeneration

The filter medium, once saturated with adsorbed haze wax, will not function effectively for dehazing, as evidence by breakthrough of hazy oil through the filtration medium.

To be efficient the filter medium needs to be regenerable. During regeneration the dehazing process can either be suspended (if a single dehazing unit is used) or can be continued in a second unit in a multiple unit operation. If regeneration takes longer than the time exhibited by the filter medium to exhibit breakthrough of hazy oil or excessive pressure drop it may be necessary to use multiple units so that one is always available for dehazing while the other(s) is/are in various stages of regeneration.

Filter material regeneration can be effected by forward flushing employing hot washing with a solvent to dissolve the wax, or backwashing/back flushing with hot solvent to dissolve the wax.

The solvent used can either be the diluent used in the dilution step (if practical) or a solvent which is a wax solvent, i.e., a solvent in which wax to naturally dissolves, or a solvent which when heated melts the wax and into which the melted wax is soluble (i.e., a hydrocarbon solvent).

It has been found that two layer of filter material have a greater than two fold effect on the time to breakthrough of haze through the filter. This is surprising because in typical filtration two layers of filter material in series increase the filtration time by no more than a factor of two as compared to a single layer. A greater than two fold effect is consistent with an adsorption mechanism.

Figure 1A:
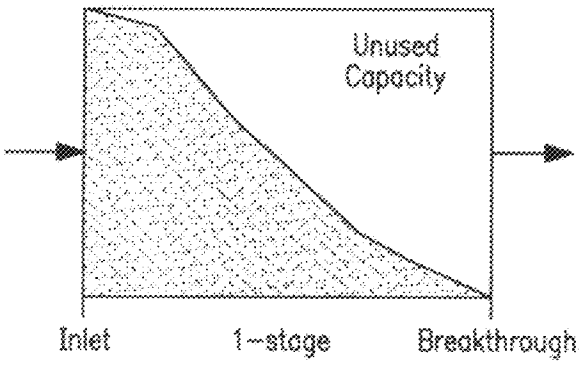

As shown in FIG. 1*a* the curve indicates the amount of capacity of the filter unit that is utilized at that distance from the inlet face or for the time before breakthrough. For a single stage filter only about 50% of the absorbent capacity has been utilized by the time haze breakthrough occurs. However, for a two stage configuration used in series while 50% of the second stage capacity has been used by the time breakthrough occurs at the outlet of stage 2, the entire capacity (100%) of the first stage has been used. In this case breakthrough occurs three times later with two stages as compared to one stage, resulting in longer time on stream before regeneration is needed and providing higher yields.

Rather that simply increasing the number of layers of filter material present in a filter element to take advantage of the above phenomenon, which might lead to construction and reliability concerns, using a multiple of vessels with at least some in series will have the same benefit as multiple layers. Of course, multiple layers of filter material in an element vessel, multiple element vessels, multiple stages of element vessels and multiple stages of multiple element vessels can be used simultaneously.

Because in the two stage operation the second stage is only used to 50% of its capacity whereas the first stage element is used to 100% of its capacity it is entirely possible and within the scope of the invention for the second stage filter at the time of breakthrough to take over the position of being a first stage filter with it effluent being sent to a full capacity stage element, be it a regenerated first stage element or to a fresh full capacity third stage element while the expended first stage element is being regenerated.

Thus, in the practice of the present invention it is preferred that the filtration process employ at least two filters in series; i.e., there is more than one filter or filtration stage, and each filter or filtration stage is used in sequence. Further each filtering stage can contain a multiplicity of individual filters or filtering substages, so as to permit the overall unit to work continuously, one or more filters or filtering substages being employed for filtering while one or more other filters or filtering substages are at various levels of regeneration. By utilizing stages in sequence, efficiency is improved permitting increased utilization of the filter capacity, while multiple substages within each stage permit continuous uninterrupted operation with at least one substage being actively engaged in each stage in the filtering operation while one or more other substage are undergoing regeneration. More than 2 stages can be employed with feed flow being shifted between the stages so that one stage is being employed as the primary stage ($1^{st}$ stage) with another stage being employed as the secondary stage ($2^{nd}$ stage) into which the effluent from the first stage is fed and out of which second stage the desired final dehazed product is recovered while yet another or more than one other stage is/are undergoing regeneration. This is described in greater detail below in FIG. 2. In the present invention, attention is also preferably paid to recovering the unfiltered lubricating oil remaining in each filter vessel when haze breakthrough occurs. The amount of lubricating oil held-up in the filter vessel depends on the total liquid volume capacity of the filter vessel and this can constitute a substantial percentage of the total overall lubricating oil being processed, depending on how long the vessel is capable of operating before haze breakthrough the volume of each vessel and on each vessel's flux. The percentage of lubricating oil held-up can be determined by dividing the volume of the vessel (representing the amount of oil held-up in the vessel) by the amount of oil passed though the vessel prior to haze breakthrough. For example, if the vessel has a total liquid volume of 3006 liters and the volume of lubricating oil filtered through the vessel prior to haze breakthrough is 19987 liters, the % of lube oil constituting hold-up is about 15%.

It is highly desirable to recover as much of this unfiltered lubricating oil as possible prior to regenerating the filter unit stage or substage which experienced the haze breakthrough. This can be accomplished by displacing the held-up lubricating oil from the filter unit stage or substage using a gas, such as nitrogen, prior to or at the very start of regeneration. It is preferred that the gas flush be conducted at a temperature low enough so that the haze wax adsorbed by the filter material does not refluidize and dissolve into the held-up lubricating oil thus raising the haze wax content of the held-up lubricating oil being recovered. Once the held-up lubricating oil has been displaced from the filter unit stage or substage, the unit can be washed with wax displacing solvent or the flush gas can be heated to displace and facilitate removal of the adsorbed haze wax from the filter.

Alternatively, a diluent liquid can be used to displace the held-up lubricating oil from the filter. The diluent liquid used can be the same diluent employed in the incubation step (if a diluent was employed) thus simplifying diluent solvent/lubricating oil separation. Simultaneous displacement of the haze wax trapped in the filter along with the recovered lubricating oil can be avoided/minimized by cooling the diluent liquid below the filtration temperature, or by the use of a diluent with a lower viscosity than that of the lubricating oil constituting the held-up oil fraction in the filter. The use of a diluent with a lower viscosity keeps the pressure drop across the filter lower than when filtering the lubricating oil, thus avoiding disengaging the trapped haze wax. Further, even if some haze wax is disengaged the voids created in the filter by such haze wax dislodgement will serve as relatively high flow rate channels bypassing the remaining trapped haze areas of the filter and permitting relatively unhindered passage of the unfiltered held-up lubricating oil to the recovery area which can be either a separate, dedicated holding zone or the main lubricating oil feed vessel. Preferably this flushing of the unfiltered lubricating oil from the filter unit by the diluent is practiced with the flow going in the same direction as employed during the filtering step, i.e., forward flow, but back flow can also be practiced at the discretion of the practitioner.

Following the flushing of the held-up lubricant from the filter zone, the diluent used in the fluid can be recycled to the filter zone until the haze in the flushing diluent reaches a saturation point after which it will no longer displace/disengage/dissolve the trapped haze wax at the temperature used. Once the held-up lubricating oil is recovered, the filter materials can be washed using hot diluent to dissolve the wax and flush it from the filter material.

A preferred regeneration process can be summarized below:

1. Flush with cold flush diluent to displace and recover the held-up lubricating oil. This cold flush diluent need not be haze-free itself. The cold flush diluent can be recovered from the displaced held-up lubricating oil using a stripper. Recover the held-up lube oil fraction and store it in a separate holding zone for recycle to a filter unit or send the recovered held-up lube oil fraction back to the main lubricating oil feed vessel.
2. Flush the filter unit with hot flush diluent to dissolve/disengage the wax from the filter material. This hot flush diluent need not be haze-free itself.
3. Flush with hot, fresh haze free flush diluent to restore the wax capture capacity of the filter material.
4. Flush with cool, haze-free flush diluent to lower the temperature of the filter.

5. Flush with cool incubation diluent (if different from the flush diluent).
6. Flush with haze-free lubricating oil/incubation diluent mixture (optional).

Step 6 is optional, and employed only to address a possible problem of effectively filtering the first incremental of haze wax containing lubricating oil for haze removal after regeneration. Step 6 would be practiced to prepare the filter and insure that it is ready to remove haze wax from feed when feed is introduced in the process for the actual separation of haze wax from feed oil to produce a recoverable dehazed lubricating oil.

Regardless of what regeneration procedure is eventually employed, it is preferred that staging be practiced to maximize filter capacity and the intervals between regenerations.

Figure 2:
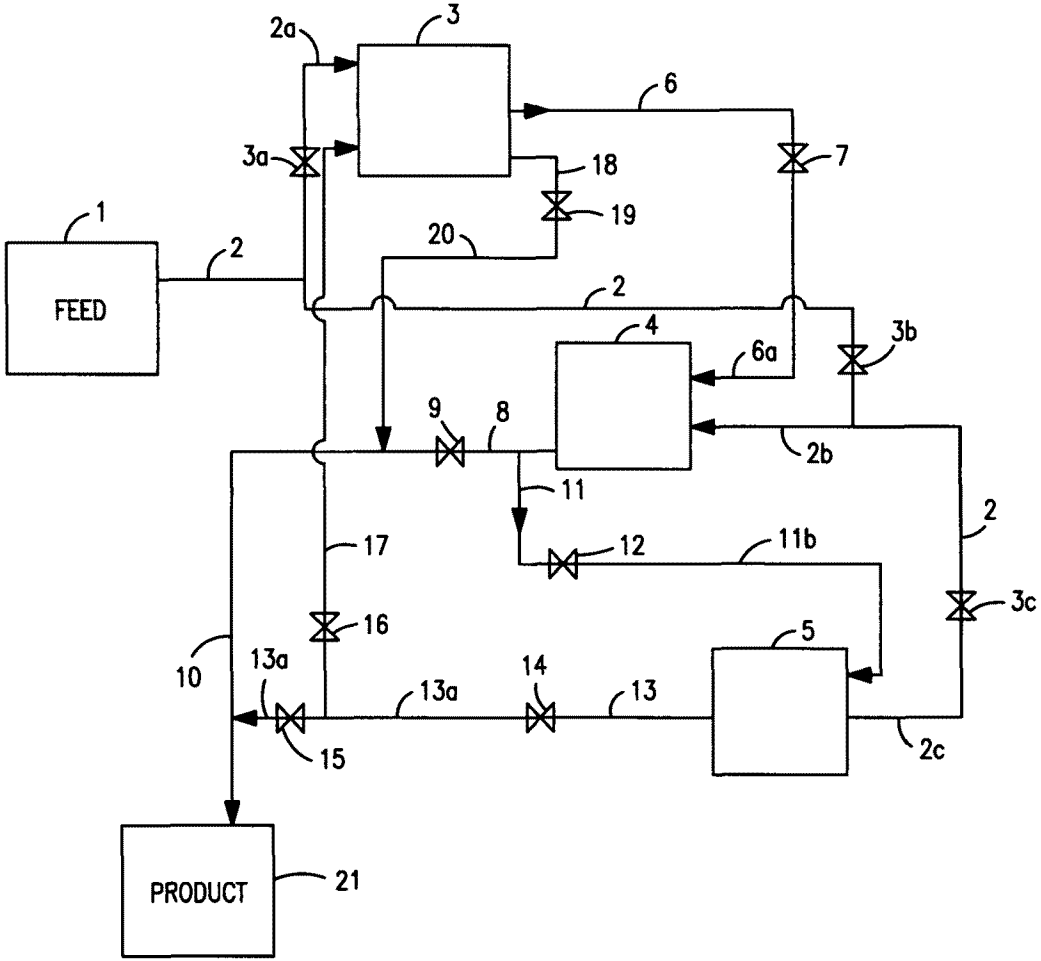
FIG. 2 is a schematic of one embodiment of a dehazing system employing multiple filter elements.

In FIG. 2 lubricating oil feed containing haze precursor material is fed from lubricating oil feed vessel 1 through line 2, valve 3*a* and line 2*a* into a first stage filter element unit 3. The effluent from filter element 3 is fed via line 6, valve 7 and line 6*a* into second stage filter element 4. The effluent from filter element 4 having been subjected to two stages of filtration is the desired product which is fed from filter element 4 via line 8, valve 9 and line 10 into product storage unit 21.

When haze breakthrough occurs in filter element unit 4, feed from lubricating oil feed vessel 1 is stopped to filter element unit 3 and is diverted to filter element unit 4 via line 2, valve 3*b* and line 2*b*, filter element unit 4 becoming in effect the new first stage filter unit while filter element unit 1 is being regenerated (not shown). The effluent from filter element unit 4 is fed via line 11, valve 12 and line 11*b* to filter element unit 5 (now functioning as the second stage filter), with effluent from filter element unit 5 being fed via line 13 valves 14 and 15 and line 13*a* into line 10 and then into product storage unit 21.

When haze breakthrough occurs in filter element unit 5, feed flow to filter element unit 4 is stopped and diverted via line 2, valve 3*c* and line 2*c* into filter element unit 5 becoming in effect the new first stage filter unit while filter element unit 4 is regenerated, not shown. The effluent from filter element unit 5 is fed via line 13 valve 14, line 13*a*, valve 16 and line 17 into a fresh, full capacity filter element, in this case regenerated filter element unit 1, filter element unit 1, becoming the new second stage filter. Filtrate from filter element unit 3 is fed via line 18, valve 19 and line 20 into line 10 and then into product stage 21. In this way a stream of dehazed oil product is continuously being sent to product storage unit 21, one filter unit is already undergoing regeneration, and two filter units are always being used in sequence, i.e., staged operation, to yield the desired product. In the above scenario appropriate valves are shut when necessary to permit the flow diversion needed to segregate the three exemplified filter element units and permit them to be used as first stage filter element units, second stage filter element units or filter element units undergoing regeneration, as needed.

As should be apparent, more filter element units can be added if additional time is needed to effect the necessary regeneration steps. Further, each filter element unit (stage) can constitute either a single element stage or multiple element substages to increase capacity. Similarly, while it is shown that the effluent from a first stage filter element unit is being fed directly into a second stage filter element unit it is entirely within the scope of this embodiment that such intermediate product, (called the stage 1 effluent) can be sent to a separate effluent storage unit, not shown, and from such unit subsequently fed to the appropriate second stage filter unit(s).

EXAMPLES

Comparative Example 1

Because typical wax haze particles are about 0.2 microns in dimension it has been found that to be effective the filter material must be a material having a majority of the surface area in pores most preferably ≦1 micron to 0.2 microns in dimension, pores being the space between strands of the material used to make the filter fiber media, the filter media having a surface area of at least 0.5 sq. meter/gram. Prior art processes employing adsorbents such as silica, alumina and zeolites which possess pores of about 0.001 micron dimension and surface area of many hundreds of sq. meter/gram are ineffective in dehazing the lubricating oil. In Table 1 information is presented showing the NTU, haze dissolution (or disappearance) temperature, appearance at 68° F., filterability and overall assessment of untreated lubricating oil and of treated lubricating oil (both in undiluted form and diluted form) following various treatments over different adsorbents, molecular sieve (Na 13×) and ZSM-5.

The heavy lubricating oil stock employed in this example is a GTL stock. Its kinematic viscosities at 40 and 100° C. are 94.98 $mm^2/s$ and 14.3 $mm^2/s$, respectively, and its 5 and 95% distillation temperatures are 904 and 1234° F. (484.4° C. and 667.6° C.), respectively, and its cloud point is 8° C.

The adsorbents used were zeolite molecular sieve Na 13× particles of about 0.7 mm diameter and Al-ZSM-5 zeolite particles of about 1 mm diameter. Molecular sieve Na 13× is reported in the literature as having a pore size of 1.32 Å and a surface area of 500 $m^2/g$ while Al-ZSM-5 is reported in the literature as having a pore size of 5.5 Å and a surface area of 400 $m^2/g$. Fluxes of 0.10 to 0.48 liter/($s \cdot m^2$) were used. The columns were 0.5-0.75 inches (1.27-1.9 cm) in diameter by 4-8 ft (122-245 cm) long.

TABLE 1

| Sample Number | Description (Temp., adsorbent, % naphtha, res time) | NTU @ 68° F. | Haze Disappearance Temp., ° C. (° F.) | Appearance @ 68° F. | Filterability 300 seconds maximum | Overall Assessment |
|---|---|---|---|---|---|---|
| FEED | | 1.0-2.1 @ 77-82° F. | 30.61 (87.1) | Hazy | >1800 sec^ | |
| RUN 2 | 13X (Gamma alumina) undiluted, @ 28° C., 40 minutes per bed volume | | | | | |
| 1 | 4-9.1 bed volume collected | 1.3-1.8 | 31.27 (88.3) | Trace Haze | | Unacceptable |
| RUN 3 | 13X, 10% diluted, @ 25° C., 105 minutes per bed volume | | | | | |
| 2 | 0.6 bed volume collected | 0.4 | 19.77 (67.6) | Sample too small | | Insufficient Data |
| 3 | 2.7 bed volume collected | 4.3 | 28.78 (83.8) | Sample too small | | Unacceptable |
| 4 | 0-9.9 bed volume collected | 2.0 | | & Trace haze | | Unacceptable |

TABLE 1-continued

| | | | | | | |
|---|---|---|---|---|---|---|
| RUN 4 | 13X, 10% diluted, @ 25° C., 210 minutes per volume collected | | | | | |
| 5 | 0.9 bed volume collected | 1.0 | 26.61 (79.9) | Sample too small | | Unacceptable |
| 6 | 2.3 bed volume collected | 1.8 | 30.61 (87.1) | Sample too small | | Unacceptable |
| 7 | 0-2.9 bed volume collected | 1.6 | 35 (95.0) | Very trace haze | | Unacceptable |
| | High Temperature (about 78° C.) | | | | | |
| RUN 5 | ZSM5, undiluted, 210 minutes per bed volume | | | | | |
| 8 | 0-2.2 bed volume collected | 0.3-0.4 | 48.89 (120*) | Clear and bright | 1103 sec | Unacceptable |
| 9 | 2.2-3.6 bed volume collected | 0.8-0.9 | 53.89 (129*) | Trace haze | | Unacceptable |
| 10 | 3.6-4.2 bed volume collected | 1.3-1.4 | 60 (140*) | Trace haze | | Unacceptable |

| Sample Number | Description (Temp., adsorbent, % naphtha, res time) | Time of Sample (min.) | Flux (units?) liters/(s · m$^2$) | Column Height Cm (feet) | Column Diameter (inches) Cm | LHSU Hr$^{-1}$ | WHSU HR$^{-1}$ |
|---|---|---|---|---|---|---|---|
| | FEED | | | | | | |
| RUN 2 | 13X (Gamma alumina) undiluted, @ 28° C. 40 minutes per bed volume | | | | | | |
| 1 | 4-9.1 bed volume collected | 160-364 | 0.48 | 122 (4) | 1.27 (0.5) | 1.5 | 1.0 |
| RUN 3 | 13X, 10% diluted, 105 minutes per bed volume | | | | | | |
| 2 | 0.6 bed volume collected | 63 | 0.20 | 122 (4) | 1.9 (0.75) | 0.6 | 0.4 |
| 3 | 2.7 bed volume collected | 283.5 | 0.20 | 122 (4) | 1.9 (0.75) | 0.6 | 0.4 |
| 4 | 0-9.9 bed volume collected | 0-1039.5 | 0.20 | 122 (4) | 1.9 (0.75) | 0.6 | 0.4 |
| RUN 4 | 13X, 10% diluted, @ 25° C., 210 minutes per volume collected | | | | | | |
| 5 | 0.9 bed volume collected | 189 | 0.20 | 245 (8) | 1.9 (0.75) | 0.3 | 0.2 |
| 6 | 2.3 bed volume collected | 483 | 0.20 | 245 (8) | 1.9 (0.75) | 0.3 | 0.2 |
| 7 | 0-2.9 bed volume collected | 0-609 | 0.20 | 245 (8) | 1.9 (0.75) | 0.3 | 0.2 |
| | High Temperature (about 78° F.) | | | | | | |
| RUN 5 | ZSM5, undiluted, 210 minutes per bed volume | | | | | | |
| 8 | 0-2.2 bed volume collected | 0-462 | 0.10 | 245 (8) | 1.9 (0.75) | 0.3 | 0.2 |
| 9 | 2.2-3.6 bed volume collected | 462-756 | 0.10 | 245 (8) | 1.9 (0.75) | 0.3 | 0.2 |
| 10 | 3.6-4.2 bed volume collected | 756-882 | 0.10 | 245 (8) | 1.9 (0.75) | 0.3 | 0.2 |

^For another sample of IP run HBS

*Result particularly high due to small amount of high melting haze & very likely hazy, no sample above 1.8 NTU has been assessed clear and bright A bed volume is the size of the adsorber vessel that is filled with adsorbent. Here it is used as the units for the volume of feed that were passed through the adsorber. For example, in Run 2 (1) 4-9.1 indicates an effluent that was collected in the experiment between when 4 and 9.1 bed volumes were passed through. The time over which the sample was collected is 40 min (the residence time for a bed volume to pass through the vessel) times the bed volumes passed or 160-364 min.

From this it is apparent that the small pore high surface area material as described in the literature is of limited effectiveness in dehazing the lubricating oil. In the single case in which a sample with a HDT of 67.6° F. (about 20° C.) was obtained, only 0.6 bed volumes were treated. At 2.7 bed volumes, the turbidity was as high as the feed. Adsorption with fixed beds of adsorbent particles are severely disadvantaged under these conditions because of excessive loss of feed in the bed at the time of regeneration, cost of regeneration fluid, if used, and the time to heat and cool the adsorbent bed without disturbing the particle packing. Typically, breakthrough times of about 100 bed volumes are targeted before regeneration is necessary.

Example 1

Various materials having pores of larger dimension (0.8 to 2.5 micron) were evaluated both as single layer and double layers of material. Each layer was about 0.3 mm thick. The filter media disks were supported by a drainage plate and sealed by O-rings in a steel housing. The filter media tubes were attached by tubing to the feed reservoir. Fluid flowed into the inside of the media tubes and through the media to the outside, where it was collected. Pressure on the feed reservoir in both cases was adjusted to maintain the desired flux of fluid through the filter.

The feed was GTL heavy wax isomerate, prepared from a full range Fischer-Tropsch wax by 2 stages of catalytic hydroisomerization, followed by distillation and then hydrofinishing. Its kinematic viscosities at 40 and 100° C. are 94.98 and 14.3 mm$^2$/s, respectively, and its 5 and 95% distillation temperature are 904 and 1234° F. (484.4° C. and 667.7° C.), respectively, and its cloud point is 8° C. The feed was used in an undiluted form. The filtration through the various media as well as NTU measurements were conducted at 19-20.5° C. NTU measurements of the filtrate were taken 1 hour to 3 days after completion of filtration. The results are presented in Table 2. HDT is haze dissolution (or disappearance) temperature and is a superior measure of the haziness of the oil compared to either NTU or clear and bright as explained above.

TABLE 2

| Media | Time on stream, min | Flux, liter/(s · m$^2$) | NTU | Appearance | HDT, ° C. | Pressure Drop, Δ in psi |
|---|---|---|---|---|---|---|
| Feed | | | 1.4 | Hazy | 27 | |
| 2.5 micron fiber metal(1), | 12-22 | 0.034 | .57 | | ~25 | 1.6-1.9 |
| 1 micron fiber glass(3), | 12-24 | 0.034 | .40 | | | 31-51 |
| 1 micron aramid(2), 1 layer, 0.3 mm thick, | 11-21 | 0.034 | .34 | | | 15-26 |
| 1 micron aramid(2), 2 layer, each 0.3 mm thick, | 14-25 | 0.034 | .11 | Clear & bright | 21.2 | 21-35 |
| 2 micron metal membrane mesh(4), | ~60 | 0.041 | 1.33 | Trace haze | | 13 |
| 1 micron metal membrane tube(5), | 75-135 | 0.020 | 1.2 | Trace haze | | >85 |
| 0.8 micron metal membrane tube(6), | 65-95 | 0.018 | 1.2 | Trace haze/Clear & bright | ~27 | >151 |

(1)Fiber metal: stainless steel, sheet or fiber mat, about 2.5 mm diameter disc, 0.5 mm thick, 2.5 micron nominal pore size spaces between metal fibers, Pall part PMF ™ FS025.
(2)Fibrillated aramid fiber filter material is disclosed and claimed in U.S. Pat. No. 5,702,616, U.S. Pat. No. 5,529,844, U.S. Pat. No. 5,628,916.
(3)Fiber glass: sheet of glass fibers, 1.0 micron nominal pore size, commercially available as Pall part Ultipor GF plus ® K010Z about 0.3 mm thick.
(4)Sintered stainless steel with embedded wire mesh, 2.0 micron nominal pore size, Pall part PMM-020.
(5)Sintered stainless steel tube, 1.0 micron nominal pore size, Pall Accusep
(6)Sintered stainless steel tube, 0.8 micron nominal pore size, Pall Accusep.

The pores of the metal membrane tubes (1 micron and 0.8 micron) are nominally the same as those of the aramid and fiberglass, and are operable, though inferior to aramid and fiberglass which are preferred.

Aramid fiber filter surface area can be estimated from the fiber filament diameter of 0.3 microns by assuming that the fibers are infinitely long cylinders, since the fibers are much longer than their diameter. The surface area calculated is 13 m$^2$/cm$^3$ of solid fiber. For a fiber density for aramid of 1.38 g/cm$^3$, this is equivalent to 10 m$^2$/g.

Figure 3:
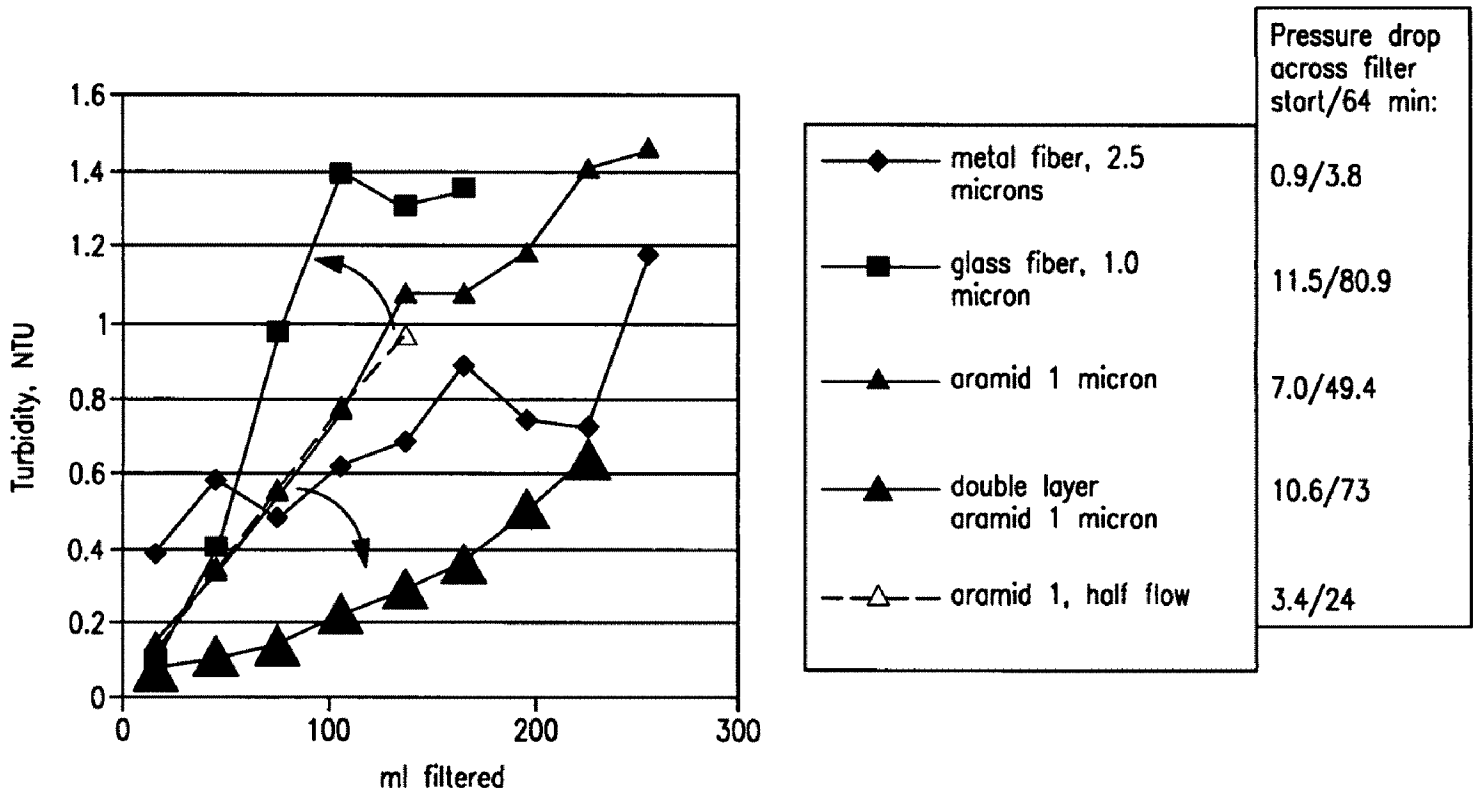
FIG. 3 graphically shows the turbidity (NTU) of recovered dehazed lubricating oil as a function of the amount of oil filtered through different filter materials.

FIG. 3 presents the data graphically showing the turbidity (NTU) of the recovered "dehazed" lubricating oil as a function of the amount of oil filtered through the different filter materials. It is clear that the metal filters (Accusep membranes) while unexpectedly operable and functional in the present process are not as effective as the aramid or fiberglass filters. The sintered stainless steel tubes (Accusep membranes) are examples of a medium which while operable are not a preferred medium for the practice of the present process to dehaze oil. The sintered stainless steel tubes have nominal pore sizes of 1 and of 0.8 microns. At a pressure drop of 150 psi, the filtrate was initially clear, but reformed haze in 2 weeks.

Example 2

Additional experiments were carried out with the same feed as used above but using 25 mm diameter glass fiber media discs. The first 25 ml of filtrate were evaluated. The results indicate that flux of about 0.10 liter/(s·m$^2$) is effective for dehazing but flux of about 0.68 liter/(s·m$^2$) of face surface area is ineffective for dehazing.

| Media nominal pore size, microns | Flux, liter/(s · m$^2$) | NTU |
|---|---|---|
| (feed) | | 1.4 |
| 2.0 | 0.68 | 0.95 |
| 2.0 | 0.10 | 0.09 |
| 2.7 | 0.10 | 0.09 |

Example 3

These examples show media with low energy surfaces. The media were fiber membrane discs of polyvinylidene difluoride about 0.2-0.5 mm thickness. Pressure drop across the media was <15 psi and the flux was about 0.034 liter/(s·m$^2$).

| Time after filtering | No filter | Turbidity, NTU 5 micron polyvinylidene difluoride fiber | Turbidity, NTU 0.45 micron polyVinylidene difluoride fiber |
|---|---|---|---|
| GTL feed used | | | |
| Feed 1 | | | |
| Immediate | ~2.5 | | |
| 6 months | Floc | 0.2 floc | <0.04 (no floc) |
| Feed 2 | | | |
| Immediate | 11.2 | 10.8 | <0.04 (no floc) |
| 21 months | 11.6 | 10.0 | <0.4 (no floc) |
| Feed 3 | | | |
| Immediate | 4.2 | 2.2 | <0.04 (no floc) |
| 21 months | 2.9 | 2.0 | <0.04 (no floc) |

-continued

| Time after filtering | No filter | Turbidity, NTU 5 micron polyvinylidene difluoride fiber | Turbidity, NTU 0.45 micron polyVinylidene difluoride fiber |
|---|---|---|---|
| Feed 4 | | | |
| Immediate | 2.5 | 0.7 | <0.04 (no floc) |
| 21 months | Much floc | <0.04, some floc | <0.04 (no floc) |

All feeds are GTL heavy wax isomerates, prepared from a full range Fischer-Tropsch wax by 2 stages of catalytic hydroisomerization, followed by distillation and then, for feeds 1 and 4 only, hydrofinishing. The GTL heavy wax isomerates were used in an undiluted form.

| Feed | kV@40 C. | kV@100 C. | Cloud pt, C. | Pour pt, C. | 5% pt | 95% pt |
|---|---|---|---|---|---|---|
| 1 | | 14.3 | 7-8 | −24 | 904 | 1234 |
| 2 | | | | | 950 | 1286 |
| 3 | 113.8 | 15.9 | −6 | −45 | 946 | 1259 |
| 4 | 85.86 | 13.16 | 6 | −32 | 929 | 1199 |

This example demonstrates that at a sufficiently small pore size even polymeric media of low surface energy (i.e., made without aromatic-, oxygen-, sulfur- or nitrogen-containing functional groups) can be effective at dehazing.

In the following examples which employ aramid fiber media, the aramid fiber used was a 1.0 micron nominal pore size aramid fiber disc 47 mm in diameter, about 0.25 mm thick, about 0.3 micron fiber diameter, about 10 $m^2/g$ surface area. The disc or discs is/are held in a stainless steel housing supported on a drainage disc sealed with polymeric O-rings. The housing was oriented such that the disks were horizontal and flow occurred in the upward direction. Portions of the filtrate were collected at various times on stream. After diluent was removed, the HDT, turbidity, and/or appearance were evaluated. The time until the filtrate reached a predetermined HDT, turbidity, or appearance is often referred to as the breakthrough time.

The HDT of the filtrate is determined by periodically recovering samples of the filtrate at different times on stream, removing the diluent then subjecting the filtrate to the HDT analysis outlined above and described and claimed in copending application JJD-0621. The breakthrough point is the sample recovery time on stream for which sample, following diluent removal, the filtrate failed to achieve the target HDT, which in the case of the present example was 20° C., when subjected to HDT analysis.

Example 4

Aramid fiber elements were evaluated for effectiveness in filtering a hazy GTL base stock (Feed 1 from the Table in Example 3) at both ambient temperature (undiluted) and at reduced temperature (diluted). In the run using no diluent, 2 aramid discs were used and the flux was 0.031 liter/($s \cdot m^2$). In the run using diluent, 4 aramid discs were used and the flux was 0.037 liter/($s \cdot m^2$). The naphtha diluent was prepared by hydroisomerizing GTL wax followed by the recovery of a fraction boiling in the naphtha boiling range by distillation. The GTL base stock was mixed with the naphtha diluent, then cooled to 7.2° C. for about 16 hours without stirring. The filtration with dilution was carried out at 7.2° C. with only occasional gentle stirring.

Break-through occurs when filtration is conducted at ambient temperature (about 19° C.), trace haze appearing in the filtered oil at 20° C. after about 68 minutes on line. From 0-47 minutes on line, the oil filtrate is clear and bright at 20° C. The pressure drop (ΔP) was about 14 psi initially, increasing to 74 psi at 68 minutes. When the hazy feed is filtered at lower than ambient temperature in the presence of an added diluent the filtered oil remained clear and bright (no haze) even after 113 and 166 minutes on line. The pressure drop was 4.2 psi initially and increased to 50 psi at 166 minutes on line.

The results are presented in Table 3.

TABLE 3

| Minutes on-line | NTU @ 20° C. | Haze Disappearance Temp. ° C. | Appearance @ 20° C. | Overall Assessment |
|---|---|---|---|---|
| 19° C., no naphtha diluent, 2 layers of aramid fiber | | | | |
| Feed (0 minutes on stream) | 1.0 | 26.5 | Hazy | |
| 3-25, 25-47 | 0.0 | 18.9 | Clear & bright | Acceptable |
| 47-66 | 0.0 | 21.2 & | Clear & bright | Acceptable |
| 66-90 | 0.1-0.2 | 21.6 & | Trace haze | Unacceptable |
| 7.2° C., 33% naphtha, 4 layers of aramid fiber | | | | |
| Feed (0 minutes on stream) | 1.0 | 25.4 | Hazy | |
| 44-63, 130-139, | 0.4* | 18.1-19.3 | Clear and bright | |

TABLE 3-continued

| Minutes on-line | NTU @ 20° C. | Haze Disappearance Temp. ° C. | Appearance @ 20° C. | Overall Assessment |
|---|---|---|---|---|
| 157-166 | | | (1-2 wks^), trace haze (3 months^) | |
| 2-16, 74-84, 104-113 | | 20 | Clear and bright (1-11 months^) | Acceptable |

*0.3-0.4 NTU contamination occurred during distillation to remove diluent.
Time after naphtha was removed from the filtrate when appearance was rated.

Example 5

The effect of flux was investigated using 2.5 micron pore size metal fiber media as in Example 1 and the GTL heavy wax isomerate as described in Example 1. It was discovered that the flux must be kept sufficiently low to permit production of a filtrate of sufficiently reduced haze wax content as reflected by a reduction in NTU values. The GTL was processed in an undiluted form at ambient temperature (about 21° C.) about 20 ml of filtrate was collected from the start of each flux condition, then the flux was adjusted to the next condition. The turbidity effects observed are due to the changes in the flux rather than to time on line because the low flux of condition 4 resulted in a recovery of the low turbidity/Clear and Bright appearance after the higher fluxes of conditions 2 and 3 which resulted in higher turbidities.

The data is presented in Table 4.

TABLE 4

| Condition | Flux, liter/(s · m$^2$) | Turbidity, NTU 20.6° C. | Appearance |
|---|---|---|---|
| 1 | 0.035 | 0.08 | Clear & Bright |
| 2 | 0.12 | 0.8 | Hazy |
| 3 | 0.24 | 1.3 | Hazy |
| 4 | 0.018 | 0.12 | Clear & Bright |

Example 6

Aramid fiber elements were effective in filtering hazy GTL base stocks over a range of conditions. Dehazing a feed of +8° C. cloud point (which had an HDT of 27° C.) was demonstrated in Example 4. Dehazings of similar feeds of cloud points of −5 and −17° C. were also carried out. Each dewaxed oil (having unfiltered haze dissolution temperatures of ≦55° C.) was heated to 55° C. to completely dissolve the haze wax, then diluted to a concentration of 67% by weight oil (33 wt % diluent) with a blend of 82% normal heptane and 18% normal octane. Then the blend was cooled gradually to −3.9° C. over 4 hrs and held at −3.9° C. for 2 hrs before beginning filtration. The HDT of the filtrate remained below 20° C. for an average of 270 minutes (range 200 to 300 minutes) on stream before breakthrough for the sample with −5° C. cloud point, while the pressure drop at breakthrough averaged 14 psi (range 11-16 psi). The HDT of the filtrate remained below 20° C. for more than 350 minutes on stream before breakthrough for the sample with −17° C. cloud point, at which time the pressure drop was 20 psi.

Example 7

Aramid fiber elements were effective in filtering hazy GTL base Do stocks made from a range of Fischer-Tropsch synthesis products, characterized by different Flory-Shultz alpha parameter. Feeds with alpha values of 0.92, 0.93, and 0.94 were tested. Those feeds were dewaxed by hydroisomerization to a cloud point of about −5° C. Each dewaxed oil, which had unfiltered HDT values between 50 to 55° C., was heated to 55° C. to completely dissolve the haze, is then diluted to a concentration of 67% by weight oil (33% diluent) with a blend of 82% normal heptane and 18% normal octane. Then the blend was cooled gradually to −3.9° C. over 4 hrs and held at −3.9° C. for 2 hrs before beginning filtration. The HDT of the filtrate (as determined following removal of the diluent) remained below 20° C. for 160 minutes on stream before breakthrough for the sample with alpha of 0.92, an average of 270 minutes (range 200-300 minutes for 3 runs) on stream before breakthrough for the sample with alpha of 0.93, and for 190 minutes on stream before breakthrough for the sample with alpha of 0.94. All these are effective dehazing processes. All fluxes were 0.034 liter/(s·m$^2$) and the range of pressure drops at breakthrough (HDT=20° C.) was 11-32 psi.

Example 8

Figure 4:
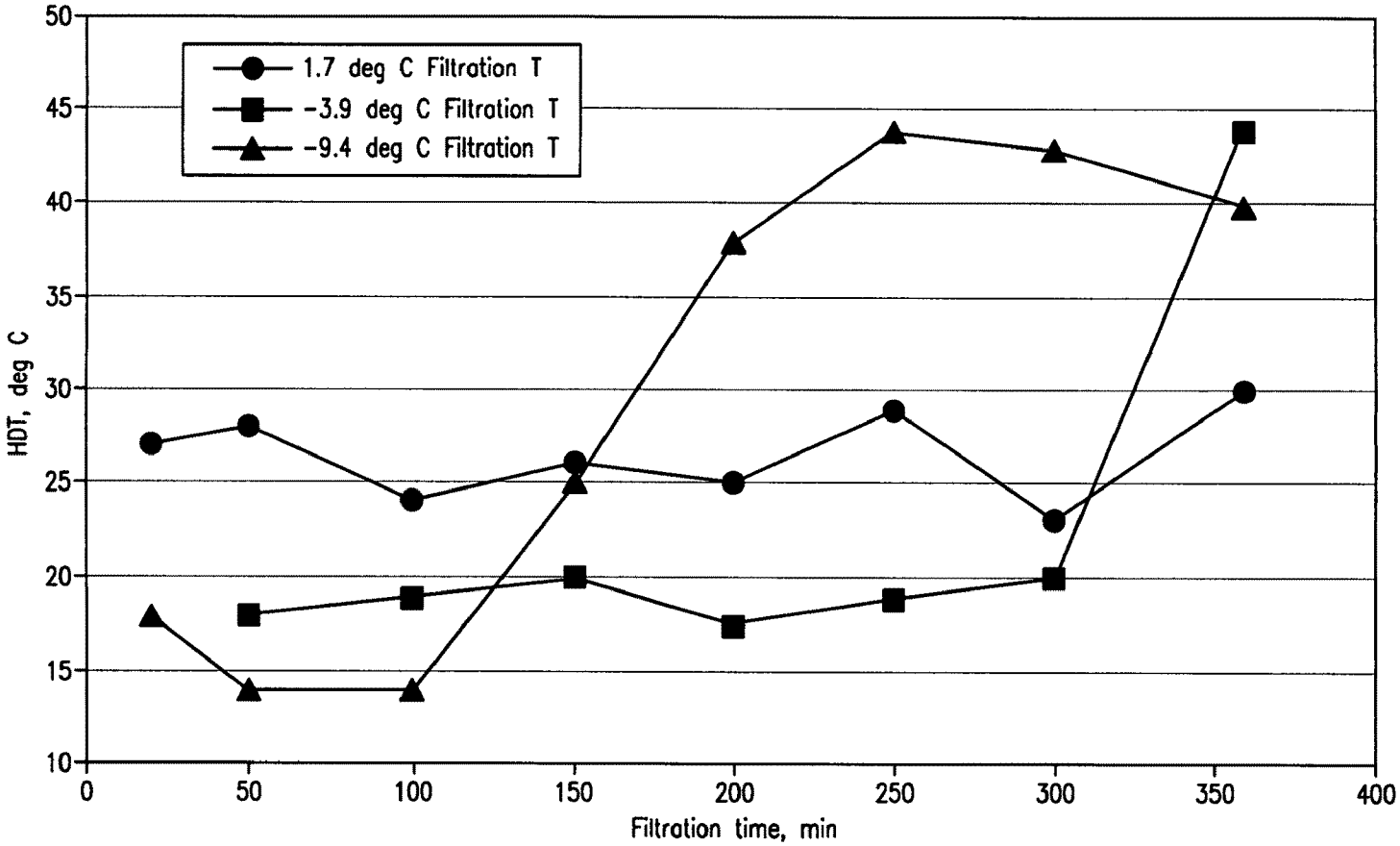
FIG. 4 presents the correlation between HDT and filtration temperature and shows that the HDT is lowered but the breakthrough time is shortened as the filtration temperature is lowered.

Breakthrough time and HDT of the dehazed oil, after diluent removal, can be conveniently controlled by adjusting the temperature of the feed. Breakthrough time can be extended by raising the temperature until just before HDT exceeds the temperature at which the oil must be haze free, 20° C. in this example. Aramid fiber elements were used with a hazy GTL base stock dewaxed by hydroisomerization to a cloud point of about −5° C. Each dewaxed oil (unfiltered HDT of between 50-55° C.) was heated to 55° C. to completely dissolve the haze, then diluted to a concentration of 67% by weight oil (33% diluent) with a blend of 82% normal heptane and 18% normal octane. Then the blend was cooled gradually to either −9.4, −3.9, or 1.7° C. over 4 hrs and held at that temperature for 2 hrs before beginning filtration at that temperature. The results are shown in FIG. 4. HDT is lowered but breakthrough time is shortened as filtration temperature is lowered. For this sample, 1.7° C. is too high a filtration temperature as seen because the HDT target of 20° C. is never achieved. At breakthrough (HDT=20° C.), the pressure drop when filtering at −9.4° C. was 21 psi, while the pressure drop when filtering at −3.9° C. was 15 psi.

Example 9

The cooling profile can be adjusted within a range while still effectively removing haze. Aramid fiber elements were used to filter hazy GTL base stocks dewaxed by hydroisomerization to a cloud point of about −5° C. The dewaxed oil (unfiltered HDT of 50 to 55° C.) was heated to 55° C. to completely dissolve the haze, then diluted to a concentration of 67% by weight oil with a blend of 25% each normal hexane, normal heptane, normal octane, and normal nonane.

Then the blend was cooled gradually to −12.2° C. over 4 hrs, then the temperature raised to 1.7° C. over 2 hrs and held at 1.7° C. for about 12 hrs before filtering. The HDT of the filtrate (as determined following removal of the diluent) remained below 20° C. for at least 234 minutes on stream (before breakthrough), at which time the pressure drop was 10 psi.

Example 10

Flux is an important parameter in the effectiveness of the process. The effectiveness will likely depend partially on the details of the media and haze structure. Aramid fiber elements were used to filter hazy GTL base stocks dewaxed by hydroisomerization to a cloud point of about −5° C. Each dewaxed oil was heated to 55° C. to completely dissolve the haze, then diluted to a concentration of 67% by weight oil with a blend of 82% normal heptane and 18% normal octane. Then the blend was cooled gradually to −3.9° C. over 4 hrs and held at that temperature for 2 hrs before filtering. This table shows that more oil/diluent blend was filtered at low flux than at high flux before breakthrough occurred of filtrate having an HDT greater than 20° C.

| Flux, liter/(s · m$^2$) | Volume filtered before breakthrough, ml | Pressure drop at HDT = 20° C., psi |
|---|---|---|
| 0.068 | 91 | |
| 0.034 | 630* | 14^ |
| 0.020 | 780 | 32 |

*average of 3 test runs, ranging from 520 to 780 ml

^average of 3 test runs, ranging from 11 to 15 psi

For filtration through media of lower porosity and permeability, where the lower porosity and permeability are caused by partially plugging new aramid fiber media with particulates, lowering the flux was effective in recovering the capacity of the filter to that of a new filter. Relative permeability of filter media was measured by comparing the time to filter a given volume of diluent. The permeability of the top and bottom layers of the used filter media were reduced by 75% and 50% relative to that of new filters. Aramid fiber elements were used to filter hazy GTL base stocks dewaxed by hydroisomerization to a cloud point of about −5° C. The dewaxed oil was heated to 55° C. to completely dissolve the haze, then diluted to a concentration of 67% by weight oil with a blend of 82% normal heptane and 18% normal octane. Then the blend was cooled gradually to −3.9° C. over 4 hrs, then held at that temperature for 2 hrs before filtering. This table shows that by lowering the flux, the capacity of a partially plugged filter could be restored to almost the level of a new filter but the capacity of the partially plugged filter was reduced when filtration is conducted at the same (high) flux as a new filter.

| Filter | Flux, liter/(s · m$^2$) | Volume filtered before breakthrough of filtrate having a HDT <20° C., ml | Pressure drop at HDT = 20° C., psi |
|---|---|---|---|
| New | 0.034 | 520 | 32 |
| Partially plugged | 0.034 | 260 | 32 |
| Partially plugged | 0.010 | 520 | 54 |

Example 11

This process can effectively remove haze after the feed is prefiltered to remove particulates. The prefiltration was carried out with a commercial 0.1 micron filter at a temperature of about 60-80° C., at which the haze was completely dissolved. Aramid fiber elements were used to filter hazy GTL base stocks dewaxed by hydroisomerization to a cloud point of about −13° C. After prefiltration, then cooling, each dewaxed oil was heated to 55° C. to completely dissolve the haze, then diluted to a concentration of 67% by weight oil with a blend of 82% normal heptane and 18% normal octane. Then the blend was cooled gradually to −3.9° C. over 5 hrs and held at that temperature for 3 hrs before filtering at a flux of 0.034 liter/(s·m$^2$). The HDT of the filtrate after removing the diluent remained below 20° C. for 135 minutes on stream, at which time the pressure drop across the filter was 18 psi.

Example 12

This process can effectively remove haze from a feed that contains aromatics, not only paraffins and naphthenes. GTL base stocks were dewaxed by hydroisomerization to a cloud point of about −5° C., both with and without hydrofinishing. The unhydrofinished base stock was analyzed and found to contain 0.7 wt % aromatic hydrocarbons by UV while the hydrofinished base stock contained 0.0 wt % aromatics by the UV. Aramid fiber elements that were 25 mm diameter and 0.2-0.3 mm thick were used to filter the hazy GTL base stock. Each dewaxed oil was heated to 55° C. to completely dissolve the haze, to then diluted to a concentration of 67% by weight oil with a blend of 25% each normal hexane, normal heptane, normal octane, and normal nonane. Then the blend was cooled gradually 1.7° C. over 1 hr, then to −12° C. over 4 hrs, then raised to −3.9° C. over 2 hrs before filtering at a flux of 0.054 liter/(s·m$^2$). Breakthrough (HDT=20° C.) occurred for the unhydrofinished base stock containing aromatics at 75 and 100 minutes on stream in duplicate runs, at which time the pressure drops were 35 and 42 psi, respectively. Breakthrough for the hydrofinished base stock that did not contain detectable aromatics occurred at 100 minutes on stream, at which time the pressure drop was 22 psi. Both base stocks were effectively dehazed by this process.

Example 13

Shear is a parameter to be considered in the effectiveness of the process. The effectiveness will likely depend partially on the magnitude of the shear, the portion of the sample exposed to the shear, the duration of the shear, and other factors. Because shear varies depending on the equipment used to prepare to filter the oil and, further, continuously throughout the actual equipment used to prepare and to filter an oil, a concise or precise definition of the shear needed for an effective process cannot be given. However, shear imposed by techniques known to those familiar with the art can be used by the practitioner to determine equipment that can be effective in dehazing. In two runs, shear was varied by changing the speed of the Rushton turbine impeller used to mix the base stock/diluent blend during the entire incubation and filtration. The average shear rate in the impeller region is approximated as 12 times the rotations per second (see R. R. Hemrajani and G. B. Tatterson, in Handbook of Industrial Mixing—Science and Practice, p. 370, Edited by: Paul, Edward L.; Atiemo-Obeng, Victor A.; Kresta, Suzanne M., 2004 John Wiley & Sons). Aramid fiber elements were used to filter hazy GTL base stocks dewaxed by hydroisomerization to a cloud point of about −5° C. Each dewaxed oil was heated to 55° C. to completely dissolve the haze, then diluted to a concentration of 67% by weight oil with a blend of 25% each normal hexane, normal heptane, normal octane, and normal nonane. Then the blend was cooled gradually to 1.7° C. over 1 hr, then gradually to −12.2° C. over 4 hrs then the temperature raised to 1.7° C. over 2 hrs before filtering at a flux of 0.034 liter/(s·m$^2$). The effect of high shear, related to the high impeller speed, on HDT of the filtrate after removing the diluent is shown in this table.

| Impeller rotational speed, rps | Average shear rate in impeller region, s$^{-1}$ | Time for HDT to reach 20° C., min | Pressure drop at HDT = 20° C., psi |
|---|---|---|---|
| 5 | 60 | 260 | 60 |
| 25 | 300 | 45 | 8 |

What is claimed is:

1. A method for reducing/mitigating waxy haze formation at a target haze disappearance temperature in base stocks susceptible to haze formation by filtering haze producing wax out of the base stock, said method comprising incubating the base stock for a time and at a temperature sufficient for haze wax particles to form and filtering the haze base stock through a filter material having a total material surface area of at least 0.5 m$^2$/g to up to 100 m$^2$/g accessible to the wax particles and pores of from 0.2 to 50 microns wherein the hazy wax is removed from the base stock and is trapped by the filter and recovering the dehazed base stock as filtrate wherein said recovered dehazed base stock remains haze-free at the target haze disappearance temperature for at least fourteen days, and wherein non-waxy particulate material is removed from the base stock before the base stock is filtered to remove the wax.

2. The method of claim 1 wherein the base stock is selected from one or more of heavy mineral oil base stock(s) and base oil(s), gas-to-liquid (GTL) base stock(s) and base oil(s), hydrodewaxed or hydroisomerized/catalytically and/or solvent dewaxed waxy feed lubricating oil base stock(s) and base oil(s).

3. The method of claim 1 wherein the base stock has a kinematic viscosity at 100° C. of at least 4 mm$^2$/s.

4. The method of claim 1 wherein the base stock has a kinematic viscosity at 100° C. of at least 6 mm$^2$/s.

5. The method of claim 1 wherein the base stock has a kinematic viscosity at 100° C. of at least 8 mm$^2$/s.

6. The method of claim 1 wherein the base stock to be dehazed is chilled using a chilling medium to a temperature below a lowest target haze disappearance temperature, the difference in temperature between the chilling medium and the base stock to be chilled being no more than 50° C.

7. The method of claim 6 wherein the difference in temperature between the chilling medium and the base stock to be chilled is no more than 35° C.

8. The method of claim 6 wherein the temperature to which the base stock is chilled is about 2° C. below the target haze disappearance temperature.

9. The method of claim 6 wherein the temperature to which the base stock is chilled is between about 10° C. to 15° C. below the target haze disappearance temperature.

10. The method of claim 6 wherein the chilling medium is chilled inert gas sparged through the base stock.

11. The method of claim 1 wherein the base stock is diluted with a diluent stock haling a kinematic viscosity at 40° C. of 0 to 4 mm$^2$/s prior to incubation.

12. The method of claim 11 herein the diluent stock is employed in an amount of about 5 to 67 wt %.

13. The method of claim 11 wherein the diluent stock is chilled to a temperature which is no more than 50° C. lower than the temperature of the base stock to which it is added.

14. The method of claim 11 wherein the temperature to which the base stock is chilled is at least about 10° C. below the target haze disappearance temperature.

15. The method of claim 11 herein the diluent is separated from the recovered dehaze base stock filtrate.

16. The method of claim 11 wherein the filter material is employed under crossflow conditions.

17. The method of claim 16 wherein the filter material is employed in the form of a tube, cylinder or spiral-wound element.

18. The method of claim 1 wherein the hazy base stock is filtered through the filter material at a filtration temperature of about 2° C. below the target haze disappearance temperature.

19. The method of claim 1 wherein the filter material as a total material surface area of at least 5 m$^2$/g to up to 100 m$^2$/g.

20. The method of claim 1 wherein the filter material has a total material surface area of at least 15 m$^2$/g.

21. The method of claim 1 wherein the filter material has pores of from 0.2 to 10 micron.

22. The method of claim 1 wherein the filter material pores of from 0.2 to ≦1 micron.

23. The method of claim 1, 18, 19, 20, 21, 22 or 17 wherein the filter material is a high surface energy material.

24. The method of claim 23 wherein the filter material is selected from the group consisting of fibrous glasses, fibrous metal, oxidized fibrous metal and functionalized polymers.

25. The method of claim 24 wherein the filter material is selected from the group consisting of polymers functionalized with one or more oxygen-containing groups, sulfur-containing groups, nitrogen-containing groups, aromatic groups.

26. The method of claim 24 wherein the filter material is selected from the group consisting of fiber glass, metal fiber, fibrillated aramid fiber or sintered stainless steel.

27. The method of claim 1 wherein wax trapped in the filter is removed to regenerate the filter for reuse.

28. The method of claim 1 wherein the hazy base stock is filtered through the filter at a flux in the range of 0.007 to 0.7 liter/(s·m$^2$) of face surface area of the filter material.

29. The method of claim 1 wherein the dehazed base stock remains haze-free at the target haze disappearance temperature for at least thirty days.

30. The method of claim 1 wherein the filter material is employed in at least two filter stages used in sequence.

31. The method of claim 1 wherein the filter material is employed in at least two filter stages, such that, while at least one stage is in operation for dehazing the hazy base stock, another stage is being regenerated.

32. A method for reducing/mitigating waxy haze formation at a target haze disappearance temperature in base stocks susceptible to haze formation by filtering haze producing wax out of the base stock, said method comprising incubating the base stock for a time and at a temperature sufficient for haze wax particles to form and filtering the haze base stock through a filter material having a total material surface area of at least 0.5 m$^2$/g to up to 100 m$^2$/g accessible to the wax particles and pores of from 0.2 to 50 microns wherein the hazy wax is removed from the base stock and is trapped by the filter and recovering the dehazed base stock as filtrate wherein said recovered dehazed base stock remains haze-free at the target haze disappearance temperature for at least fourteen days, wherein wax trapped in the filter is removed to regenerate the filter for reuse or wherein the filter material is employed in at least two filter stages used in sequence such that while a stage is in operation for dehazing a hazy base stock another stage is being regenerated, and wherein the filter material is regenerated by the process comprising the steps of:

1) flushing with cold flush diluent to displace and recover any base stock held up in the filter;
2) flushing the cold flushed filter with hot flush diluent;
3) flushing the hot flushed filter with hot haze-free flush diluent;
4) flushing the hot flushed filter with cool haze-free flush diluent to lower the temperature of the filter; and
5) flush with cool incubation diluent of different from the flush diluent of step 4.

33. The method of claim 32 further comprising the step of:

6) flushing with a mixture of haze-free base stock/incubation diluent.

* * * * *